US010981386B2

(12) United States Patent
Ozaki et al.

(10) Patent No.: US 10,981,386 B2
(45) Date of Patent: Apr. 20, 2021

(54) MOISTURE RETENTION DEVICE, MAINTENANCE DEVICE, AND LIQUID JETTING APPARATUS

(71) Applicant: FUJIFILM Corporation, Tokyo (JP)

(72) Inventors: Yuichi Ozaki, Kanagawa (JP); Makoto Takeuchi, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 16/683,261

(22) Filed: Nov. 14, 2019

(65) Prior Publication Data

US 2020/0079090 A1 Mar. 12, 2020

Related U.S. Application Data

(63) Continuation of application No. PCT/JP2018/019602, filed on May 22, 2018.

(30) Foreign Application Priority Data

Jun. 15, 2017 (JP) ..... JP2017-118037

(51) Int. Cl.
*B41J 2/165* (2006.01)

(52) U.S. Cl.
CPC ..... *B41J 2/16505* (2013.01)

(58) Field of Classification Search
CPC ..... B41J 2/16505; B41J 2/16523; B41J 2/16517; B41J 2/16508; B41J 2/16535; B41J 2/16588; B41J 2/165; B41J 2/16511; B41J 2/16547; B41J 2/17536; B41J 2/1753; B41J 2/1754
See application file for complete search history.

(56) References Cited

U.S. PATENT DOCUMENTS

| | | | |
|---|---|---|---|
| 6,357,854 | B1 | 3/2002 | Igval et al. |
| 7,780,260 | B2 | 8/2010 | Usui |
| 9,463,626 | B2 | 10/2016 | Tsuzawa |
| 2010/0147891 | A1 | 6/2010 | Yoshihisa |
| 2016/0200106 | A1 | 7/2016 | Nakano |

FOREIGN PATENT DOCUMENTS

| | | |
|---|---|---|
| JP | H06340071 | 12/1994 |
| JP | 2006123240 | 5/2006 |
| JP | 2007175941 | 7/2007 |

(Continued)

OTHER PUBLICATIONS

"International Search Report (Form PCT/ISA/210) of PCT/JP2018/019602", dated Jun. 26, 2018, with English translation thereof, pp. 1-5.

(Continued)

*Primary Examiner* — Kristal Feggins
(74) *Attorney, Agent, or Firm* — JCIPRNET

(57) ABSTRACT

Provided are a moisture retention device, a maintenance device, and a liquid jetting apparatus with which it is possible to avoid contact between moisture retention liquid stored in a cap and a nozzle surface. The moisture retention device includes the cap for moisture retention of the nozzle surface of a liquid jetting head, the cap includes a liquid retention portion (488D) in which moisture retention liquid is retained, the liquid retention portion is a housing of which an upper surface (488C) is open, and a wall (488B) of the housing is provided with an overflow starting point (510) having a structure that penetrates the wall.

9 Claims, 18 Drawing Sheets

(56) References Cited

FOREIGN PATENT DOCUMENTS

| | | |
|---|---|---|
| JP | 2008522860 | 7/2008 |
| JP | 2010125620 | 6/2010 |
| JP | 2010142982 | 7/2010 |
| JP | 2015066761 | 4/2015 |
| JP | 2015080913 | 4/2015 |

OTHER PUBLICATIONS

"Written Opinion of the International Searching Authority (Form PCT/ISA/237) of PCT/JP2018/019602", dated Jun. 26, 2018, with English translation thereof, pp. 1-12.
"Office Action of Japan Counterpart Application", dated Jun. 29, 2020, with English translation thereof, pp. 1-14.
"Office Action of Japan Counterpart Application" with English translation thereof, dated Jan. 21, 2021, p. 1-p. 8.

MOISTURE RETENTION DEVICE, MAINTENANCE DEVICE, AND LIQUID JETTING APPARATUS

CROSS-REFERENCE TO RELATED APPLICATIONS

The present application is a Continuation of PCT International Application No. PCT/JP2018/019602 filed on May 22, 2018 claiming priority under 35 U.S.C § 119(a) to Japanese Patent Application No. 2017-118037 filed on Jun. 15, 2017. Each of the above applications is hereby expressly incorporated by reference, in their entirety, into the present application.

BACKGROUND OF THE INVENTION

1. Field of the Invention

The present invention relates to a moisture retention device, a maintenance device, and a liquid jetting apparatus. Particularly, the present invention relates to the structure of a moisture retention device.

2. Description of the Related Art

In a case where a liquid jetting head is not used for a long period of time, jetting abnormality caused by drying of a solvent from a nozzle may occur. In a case where the liquid jetting head is not used for a certain period of time or longer, a nozzle surface is covered with a cap. The nozzle surface is a surface in which a nozzle opening is formed.

Generally, the cap is a housing provided with an opening portion. The cap is mounted on the liquid jetting head with a distal end of the liquid jetting head in a liquid jetting direction being fitted into the opening portion such that the nozzle surface is sealed.

A liquid jetting apparatus comprising a cap is described in JP2015-066761A. A liquid retention portion in which moisture retention liquid is stored is provided in a main body of the cap described in JP2015-066761A. In a case where the cap is mounted on a liquid jetting head, a nozzle disposition portion of the liquid jetting head is disposed close to the liquid retention portion and a nozzle surface is moisturized.

A printer comprising a cap is described in JP2008-522860A. The cap described in JP2008-522860A is formed of hydrophilic sheet material.

An ink jet printer comprising a cap covering a nozzle surface of a liquid jetting head is described in JP2007-175941A. The cap described in JP2007-175941A comprises an annular sealing lip. A groove is formed on a distal end of the annular sealing lip along a direction in which the lip continues. Accordingly, the inside of the cap is doubly partitioned by means of opposite side walls of the groove such that the airtightness of the inside of the cap is increased.

SUMMARY OF THE INVENTION

There is a case where the liquid surface of moisture retention liquid stored in a cap swells due to the surface tension of the moisture retention liquid and thus a bridge between the moisture retention liquid and a nozzle surface of a liquid jetting head is formed such that the jetting performance is deteriorated. Meanwhile, in a case where a distance between the cap and the nozzle surface is increased for the purpose of preventing the bridge between the moisture retention liquid and the nozzle surface being formed, for example, evaporation or the like of the moisture retention liquid occurs such that the amount of the moisture retention liquid decreases and the nozzle surface dries if the liquid surface of the moisture retention liquid does not swell. Accordingly, the jetting performance of the liquid jetting head may be deteriorated.

To control the amount of the moisture retention liquid such that the liquid surface of the moisture retention liquid does not swell, a sensor measuring the height of the liquid surface of the moisture retention liquid and a precision moisture retention liquid supply mechanism are needed. Note that, the moisture retention liquid may include ink that is discharged from the liquid jetting head in a process such as dummy jetting.

In JP2015-066761A, JP2008-522860A, and JP2007-175941A, there is no description about the above-described problem and there is no description about an effective solution for solving the above-described problem.

In the case of the cap of a sheet formed of hydrophilic material described in JP2008-522860A, fixation of ink, fixation of moisture retention liquid, and a decrease in hydrophilicity may occur in a case where a chemical reaction between the hydrophilic material and the ink or the moisture retention liquid occurs.

The groove formed in the distal end of the annular seal lip described in JP2007-175941A does not have a function of holding the liquid surface of moisture retention liquid in the cap at a certain position.

The invention is made in consideration of above-described circumstances and an object thereof is to provide a moisture retention device, a maintenance device, and a liquid jetting apparatus with which it is possible to avoid contact between moisture retention liquid stored in a cap and a nozzle surface.

In order to achieve the above object, aspects of the invention as follow are provided.

According to a first aspect, there is provided a moisture retention device comprising a cap for moisture retention of a nozzle surface of a liquid jetting head, in which the cap comprises a liquid retention portion in which moisture retention liquid is retained, the liquid retention portion is a housing of which an upper surface is open, and a wall of the housing is provided with an overflow starting point having a structure that penetrates the wall.

According to the first aspect, the overflow starting point penetrating the wall is provided on the wall of the liquid retention portion. Accordingly, in a case where a liquid surface of the moisture retention liquid reaches the overflow starting point, the moisture retention liquid is discharged to the outside from the inside of the liquid retention portion through the overflow starting point. The liquid surface of the moisture retention liquid is restrained from swelling and the liquid surface of the moisture retention liquid is maintained at a certain position so that contact between the nozzle surface and the moisture retention liquid can be avoided.

Examples of the configuration of the cap include a configuration in which a cap main body and a sealing member are provided. The cap main body comprises the liquid retention portion. The sealing member comes into close contact with a distal end portion of the liquid jetting head in a case where the cap is mounted onto the liquid jetting head.

Examples of the liquid retention portion as the housing include a liquid retention portion having a rectangular parallelepiped shape. The upper surface of the housing is a surface of the liquid retention portion that faces the nozzle surface of the liquid jetting head in a case where the cap is mounted onto the liquid jetting head.

A position at which the overflow starting point is formed is separate from the nozzle surface of the liquid jetting head mounted into the cap by a certain distance. The certain distance from the nozzle surface can be determined in the viewpoint of performing moisture retention of the nozzle surface.

A second aspect provides the moisture retention device according to the first aspect, in which the overflow starting point may include a through-groove formed on an upper surface of the wall.

According to the second aspect, it is possible to discharge the moisture retention liquid through the through-groove formed on the upper surface of the wall of the liquid retention portion.

As the planar shape of the through-groove, a triangular shape, a quadrangular shape, and a semi-circular shape can be applied.

A third aspect provides the moisture retention device according to the first aspect or the second aspect, in which the overflow starting point may include a through-hole formed in the wall.

According to the third aspect, it is possible to discharge the moisture retention liquid through the through-hole formed in the wall of the liquid retention portion.

As the planar shape of the through-hole, a triangular shape, a quadrangular shape, a circular shape, and an elliptical shape can be applied. As the planar shape of the through-hole, an oval shape obtained by combining a quadrangular shape and a circular shape may also be applied.

A fourth aspect provides the moisture retention device according to any one of the first aspect to the third aspect, in which the overflow starting point may be subjected to a hydrophilic treatment.

According to the fourth aspect, the wettability of the overflow starting point is improved and discharge of the moisture retention liquid reaching the overflow starting point is promoted.

Examples of the overflow starting point subjected to the hydrophilic treatment include a case where the angle of contact of the moisture retention liquid with respect to the overflow starting point is equal to or smaller than 90 degrees.

A fifth aspect provides the moisture retention device according to any one of the first aspect to the fourth aspect, in which the liquid retention portion may have a shape of which a length in a first direction is longer than a length in a second direction orthogonal to the first direction and the overflow starting point may be formed on at least one of a first wall along the first direction or a second wall along the first direction.

According to the fifth aspect, it is possible to discharge the moisture retention liquid through the overflow starting point formed on at least one of the first wall along a longitudinal direction of the liquid retention portion, which is the first direction, or the second wall.

A sixth aspect provides the moisture retention device according to the fifth aspect, in which a plurality of the overflow starting points may be formed on at least one of the first wall or the second wall.

According to the sixth aspect, even in a case where the levelness error of the cap in the first direction is great, it is possible to discharge the moisture retention liquid through any of the plurality of overflow starting points.

A seventh aspect provides the moisture retention device according to any one of the first aspect to the sixth aspect, in which the liquid retention portion may have a shape of which a length in a first direction is longer than a length in a second direction orthogonal to the first direction and the overflow starting point may be formed on at least one of a third wall along the second direction or a fourth wall along the second direction.

According to the seventh aspect, it is possible to discharge the moisture retention liquid through the overflow starting point formed on at least one of the third wall along a transverse direction of the liquid retention portion, which is the second direction, or the fourth wall along the second direction.

An eighth aspect provides the moisture retention device according to any one of the first aspect to the seventh aspect, in which the cap may be disposed to be inclined with respect to a horizontal plane in accordance with the liquid jetting head that is disposed to be inclined with the nozzle surface disposed to be inclined with respect to the horizontal plane, and the overflow starting point may be formed on the wall on a lower side of a slope of the liquid retention portion that is disposed to be inclined with respect to the horizontal plane in accordance with the cap.

According to the eighth aspect, it is possible to discharge the moisture retention liquid through the overflow starting point formed on the wall on the lower side of the slope of the liquid retention portion.

A ninth aspect provides the moisture retention device according to any one of the first aspect to the eighth aspect, in which the cap may comprise a moisture retention liquid discharge port through which the moisture retention liquid overflowing out of the liquid retention portion is discharged to an outside of the cap.

According to the ninth aspect, it is possible to discharge the moisture retention liquid overflowing out of the liquid retention portion to the outside of the cap.

According to a tenth aspect, there is provided a maintenance device comprising a moisture retention device for moisture retention of a nozzle surface of a liquid jetting head, in which the moisture retention device comprises a cap comprising a liquid retention portion in which moisture retention liquid is retained, the liquid retention portion is a housing of which an upper surface is open, and a wall of the housing is provided with an overflow starting point having a structure that penetrates the wall.

According to the tenth aspect, it is possible to achieve the same effect as the first aspect.

In the tenth aspect, the same points as those specified in the second aspect to the ninth aspect can be appropriately combined with each other. In this case, a constituent element carrying out a process or a function specified in the moisture retention device can be understood as a constituent element of the maintenance device that carries out a process or a function corresponding thereto.

The maintenance device may comprise the moisture retention device according to any one of the first aspect to the ninth aspect and a head moving device that relatively moves the liquid jetting head.

According to an eleventh aspect, there is provided a liquid jetting apparatus comprising a liquid jetting head and a moisture retention device for moisture retention of a nozzle surface of the liquid jetting head, in which the moisture retention device comprises a cap comprising a liquid retention portion in which moisture retention liquid is retained, the liquid retention portion is a housing of which an upper surface is open, and a wall of the housing is provided with an overflow starting point having a structure that penetrates the wall.

According to the eleventh aspect, it is possible to achieve the same effect as the first aspect.

In the eleventh aspect, the same points as those specified in the second aspect to the ninth aspect can be appropriately combined with each other. In this case, a constituent element carrying out a process or a function specified in the moisture retention device can be understood as a constituent element of the liquid jetting apparatus that carries out a process or a function corresponding thereto.

The liquid jetting apparatus may comprise the moisture retention device according to any one of the first aspect to the ninth aspect and a head moving device that relatively moves the liquid jetting head.

According to the invention, the overflow starting point penetrating the wall is provided on the wall of the liquid retention portion. Accordingly, in a case where a liquid surface of the moisture retention liquid reaches the overflow starting point, the moisture retention liquid is discharged to the outside from the inside of the liquid retention portion through the overflow starting point. The liquid surface of the moisture retention liquid is restrained from swelling and the liquid surface of the moisture retention liquid is maintained at a certain position so that contact between the nozzle surface and the moisture retention liquid can be avoided.

DESCRIPTION OF THE PREFERRED EMBODIMENTS

Figure 1:
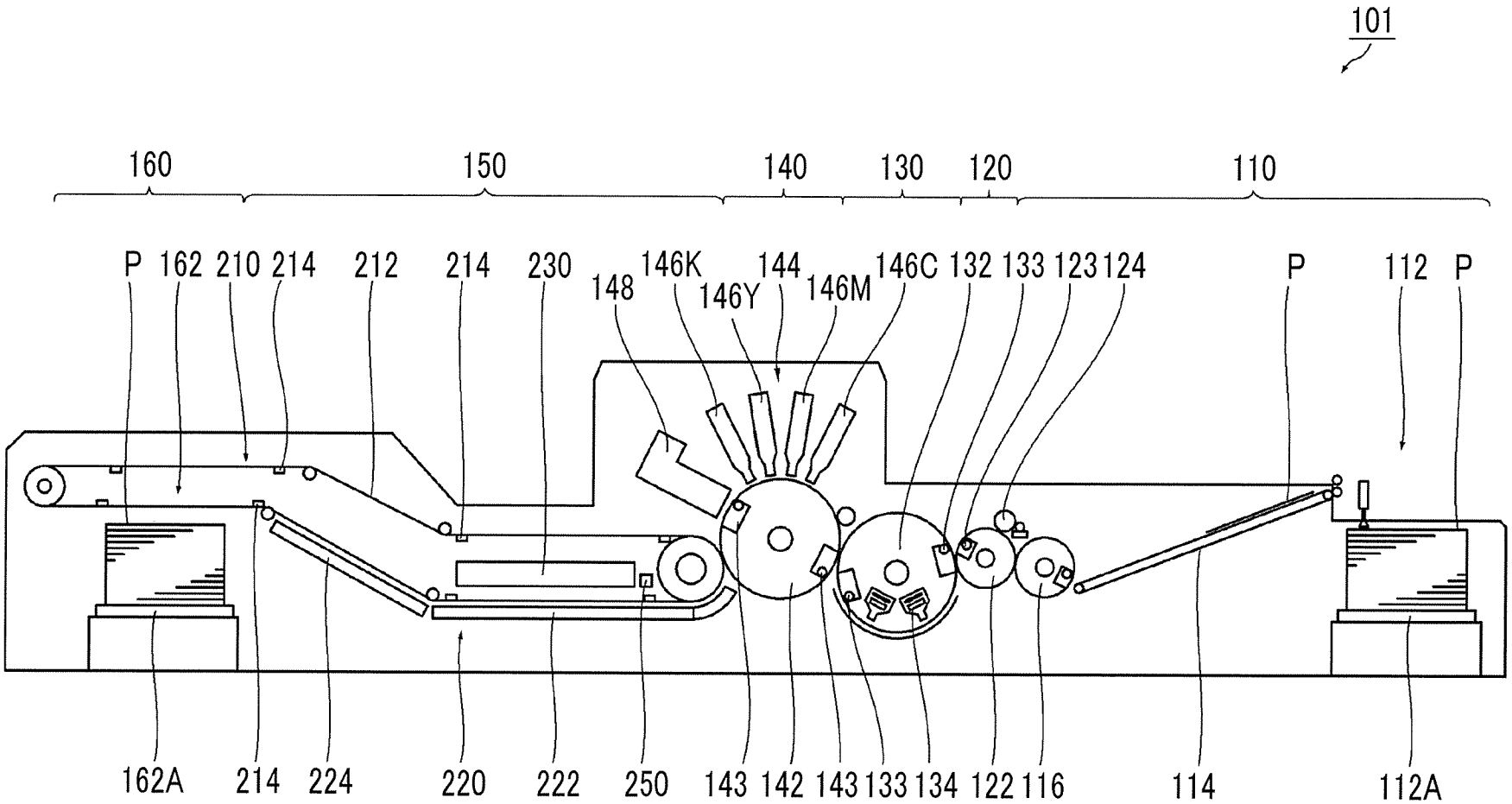
FIG. 1 is an entire configuration view illustrating a schematic configuration of an ink jet printer.

Hereinafter, a preferred embodiment of the present invention will be described in detail with reference to attached drawings. In the present specification, the same constituent elements are given the same reference numerals and repetitive description will be omitted.

[Example of Configuration of Ink Jet Printer]

FIG. 1 is an entire configuration view illustrating a schematic configuration of an ink jet printer. An ink jet printer 101 shown in FIG. 1 is a sheet type color ink jet printer that prints a color image on a sheet of paper P. The ink jet printer 101 is an example of a liquid jetting apparatus.

Figure 6:
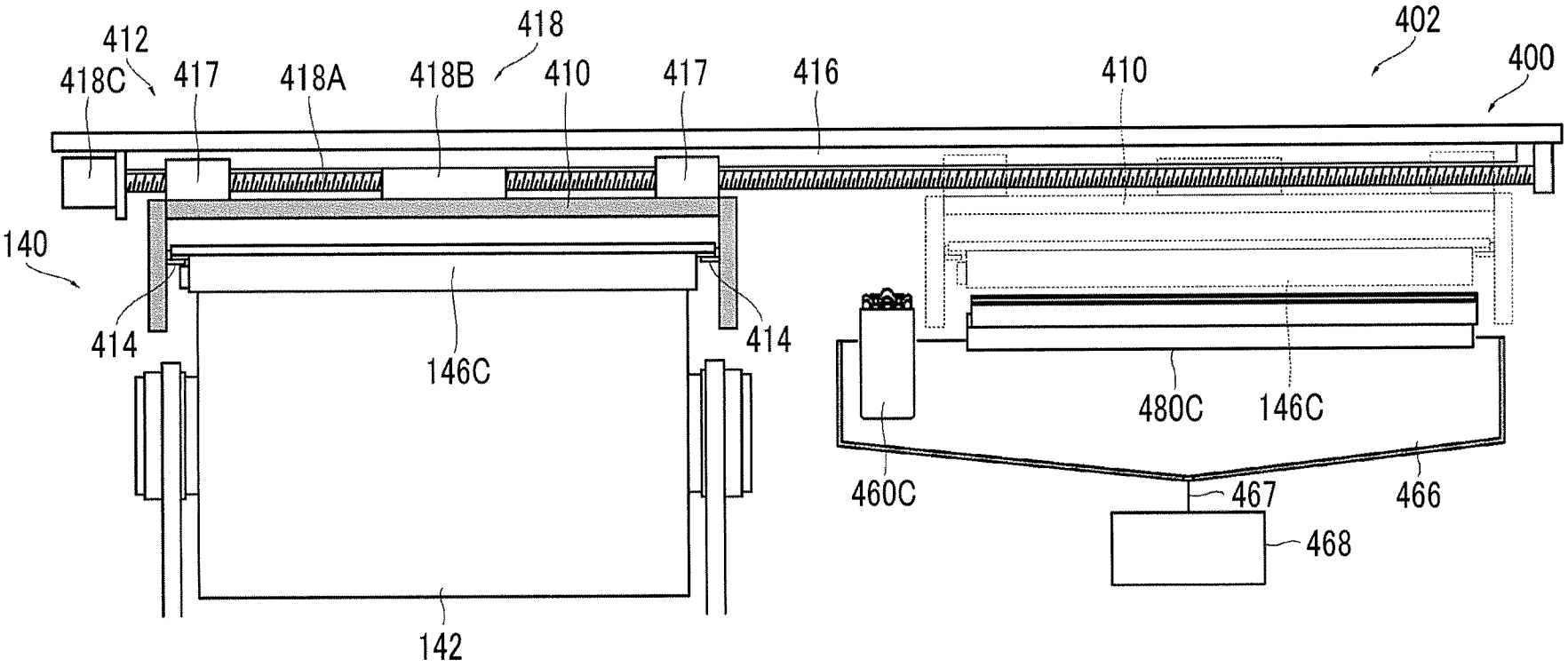
FIG. 6 is a front view schematically illustrating a schematic configuration of a maintenance device.

The ink jet printer 101 comprises a paper feeding unit 110, a treatment liquid applying unit 120, a treatment liquid drying unit 130, a drawing unit 140, an ink drying unit 150, and an accumulation unit 160. In addition, the ink jet printer 101 comprises a maintenance device, which is not shown in FIG. 1. The maintenance device is shown in FIG. 6 and is given a reference symbol "400".

The paper feeding unit 110 automatically feeds the paper P one by one. The paper feeding unit 110 comprises a paper feeding device 112, a feeder board 114, and a paper feeding drum 116. The paper feeding device 112 extracts the paper P one by one from a bundle of papers P set in a paper feeding tray 112A in a top-from-bottom order and feeds the paper P to the feeder board 114. The feeder board 114 transports, to the paper feeding drum 116, the paper P received from the paper feeding device 112.

The paper feeding drum 116 receives the paper P fed from the feeder board 114 and transports the received paper P to the treatment liquid applying unit 120.

The treatment liquid applying unit 120 applies pretreatment liquid to the paper P. The pretreatment liquid is liquid having a function of aggregating, insolubilizing, or thickening a color material component in the ink. The treatment liquid applying unit 120 comprises a treatment liquid applying drum 122 and a treatment liquid applying device 124.

The treatment liquid applying drum 122 receives the paper P from the paper feeding drum 116 and transports the received paper P to the treatment liquid drying unit 130. The treatment liquid applying drum 122 comprises a gripper 123 on a circumferential surface thereof and rotates with a leading end portion of the paper P being held by the gripper 123 such that the paper P is transported in a state of being wound on the circumferential surface.

The treatment liquid applying device 124 applies pretreatment liquid to the paper P transported by means of the treatment liquid applying drum 122. The pretreatment liquid is applied by means of a roller.

The treatment liquid drying unit 130 performs a drying process on the paper P to which the pretreatment liquid is applied. The treatment liquid drying unit 130 comprises a treatment liquid drying drum 132 and a warm air blower 134. The treatment liquid drying drum 132 receives the paper P from the treatment liquid applying drum 122 and transports the received paper P to the drawing unit 140. The treatment liquid drying drum 132 comprises a gripper 133 on a circumferential surface thereof. The treatment liquid drying drum 132 rotates with the leading end portion of the paper P being held by means of the gripper 133 such that the paper P is transported.

The warm air blower 134 is installed inside the treatment liquid drying drum 132. The warm air blower 134 blows warm air to the paper P transported by means of the treatment liquid drying drum 132 in order to dry the pretreatment liquid.

The drawing unit 140 comprises a drawing drum 142, a head unit 144, and a scanner 148. The drawing drum 142 receives the paper P from the treatment liquid drying drum 132 and transports the received paper P to the ink drying unit 150. The drawing drum 142 comprises a gripper 143 on a circumferential surface thereof and rotates with the leading end portion of the paper P being held by the gripper 143 such that the paper P is transported in a state of being wound on the circumferential surface. The drawing drum 142 comprises an adsorption mechanism (not shown) and transports the paper P by adsorbing, on the circumferential surface, the paper P wound on the circumferential surface.

A negative pressure is used for the adsorption. The drawing drum 142 comprises a large number of adsorption holes in the circumferential surface thereof and sucks the paper P through the adsorption holes from the inside such that the paper P is adsorbed onto the circumferential surface.

The head unit 144 comprises a liquid jetting head 146C jetting cyan ink droplets, a liquid jetting head 146M jetting magenta ink droplets, a liquid jetting head 146Y jetting yellow ink droplets, and a liquid jetting head 146K jetting black ink droplets.

Note that, the alphabets given to the reference symbol "146" representing the liquid jetting heads represent the colors of ink jetted from the liquid jetting heads. "C" represents cyan. "M" represents magenta and "Y" represents yellow. "K" represents black.

The liquid jetting head 146C, the liquid jetting head 146M, the liquid jetting head 146Y, and the liquid jetting head 146K are disposed at certain intervals on a path along which the paper P is transported by means of the drawing drum 142. The liquid jetting head 146C, the liquid jetting head 146M, the liquid jetting head 146Y, and the liquid jetting head 146K constitute one head unit 144 while being installed in a sending device not shown in FIG. 1. The sending device is shown in FIG. 6 and is given a reference symbol "418".

The sending device is provided between the drawing unit 140 and the maintenance device such that the liquid jetting head 146C, the liquid jetting head 146M, the liquid jetting head 146Y, and the liquid jetting head 146K can be moved.

The maintenance device which is not shown in FIG. 1 is a processing unit that performs capping or the like for cleaning and moisture retention of the liquid jetting head 146C, the liquid jetting head 146M, the liquid jetting head 146Y, and the liquid jetting head 146K. The maintenance device is installed while being aligned with the drawing drum 142 in an axial direction of a rotary shaft of the drawing drum 142.

Note that, in the present example, a configuration in which ink of four colors (cyan, magenta, yellow, and black) is used has been described as an example. However, a combination of the colors of ink and the number of colors is not limited to that in the present embodiment and light-colored ink, dark-colored ink, and special color ink may be added as necessary. For example, a configuration in which a liquid jetting head jetting light color ink such as light cyan ink or light magenta ink is added can also be adopted and the order in which the liquid jetting heads for the respective colors are disposed is not particularly limited.

When ink droplets are jetted from nozzles of the liquid jetting head 146C, the liquid jetting head 146M, the liquid jetting head 146Y, and the liquid jetting head 146K toward the paper P transported by means of the drawing drum 142, an image is recorded on the paper P.

The scanner 148 reads the image on the paper P which is recorded by means of the liquid jetting head 146C, the liquid jetting head 146M, the liquid jetting head 146Y, and the liquid jetting head 146K.

The ink drying unit 150 performs a drying process with respect to the paper P on which the image has been recorded by means of the drawing unit 140. The ink drying unit 150 comprises a chain delivery 210, a paper guide 220, a warm air blowing unit 230, and a paper detection sensor 250.

The chain delivery 210 receives the paper P from the drawing drum 142 and transports the received paper P to the accumulation unit 160. The chain delivery 210 comprises a pair of endless chains 212 that travels along a specific traveling route and transports the paper P along a specific transportation route with the leading end portion of the paper P being held by means of grippers 214 provided for the pair of chains 212. A plurality of the grippers 214 are provided at certain intervals along a traveling direction of the chains 212.

The paper guide 220 is a member that guides transportation of the paper P that is performed by means of the chain delivery 210. The paper guide 220 is composed of a first paper guide 222 and a second paper guide 224.

The first paper guide 222 guides the paper P transported through a first transportation section of the chain delivery 210. The second paper guide 224 guides the paper transported through a second transportation section, which is a stage after the first transportation section.

The warm air blowing unit 230 blows warm air to the paper P transported by means of the chain delivery 210. The paper detection sensor 250 detects presence or absence of the paper P. Examples of the paper detection sensor 250 include a reflection type optical sensor and a transmission type optical sensor.

The accumulation unit 160 comprises an accumulation device 162 that receives the paper P transported from the ink drying unit 150 by means of the chain delivery 210 and accumulates the paper P. The chain delivery 210 releases the paper P at a predetermined accumulation position determined.

The accumulation device 162 comprises an accumulation tray 162A. The accumulation device 162 receives the paper P released from the chain delivery 210 and accumulates a bundle of the papers P on the accumulation tray 162A.

[Example of Configuration of Liquid Jetting Head]

<Entire Configuration>

Next, the liquid jetting heads will be schematically described. The ink jet printer 101 shown in FIG. 1 comprises the liquid jetting head 146C, the liquid jetting head 146M, the liquid jetting head 146Y, and the liquid jetting head 146K and the same configuration can be applied to the liquid jetting head 146C, the liquid jetting head 146M, the liquid jetting head 146Y, and the liquid jetting head 146K. In the following description, the liquid jetting heads are represented by using a reference symbol "146".

Figure 2:
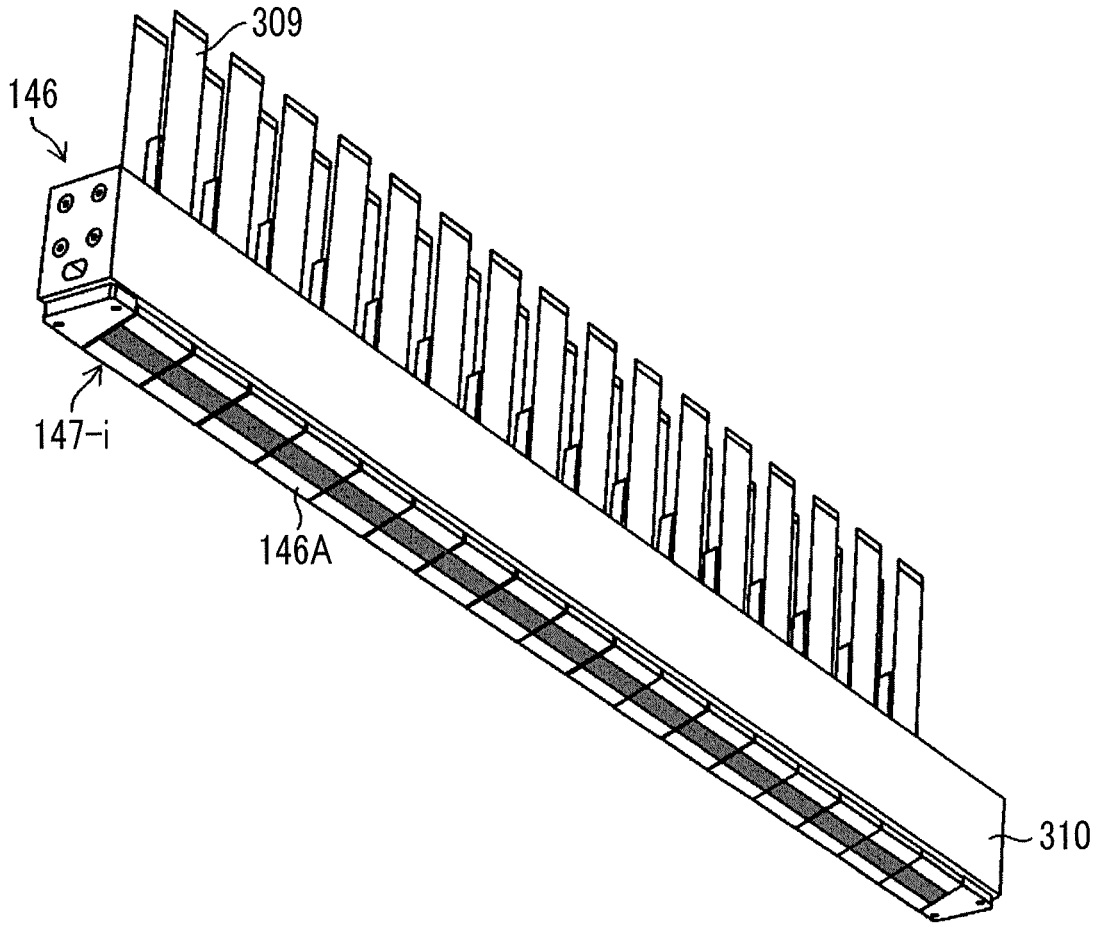
FIG. 2 is a perspective view illustrating the configuration of a distal end portion of a liquid jetting head.

FIG. 2 is a perspective view illustrating the configuration of a distal end portion of the liquid jetting head. The liquid jetting head 146 is a line type liquid jetting head including a nozzle array that can record an image at a specific recording resolution by scanning the entire recording region on the paper P in a width direction of the paper P once. Such a liquid jetting head is also called a full-line type liquid jetting head or a page-wide head. The width direction of the paper P is a direction orthogonal to a transportation direction of the paper P and is a direction parallel to a printing surface of the paper P.

The distal end portion of the liquid jetting head 146 includes a nozzle surface 146A. Nozzle openings of nozzles from which ink is jetted are formed in the nozzle surface 146A. The distal end portion of the liquid jetting head 146 includes an end of the liquid jetting head 146 on a side at which ink is jetted.

In addition, the liquid jetting head 146 has a structure in which a plurality of head modules 147-*i* are connected in a line along a longitudinal direction. Note that, "i" is an integer from 1 to n. The head modules 147-*i* are integrated with each other by being attached to a supporting frame 310. Constituent elements shown in FIG. 2 to which a reference symbol "309" is given are cables for electrical connection that extend from the head modules 147-*i* respectively.

<Disposition of Nozzle Openings>

Figure 3:
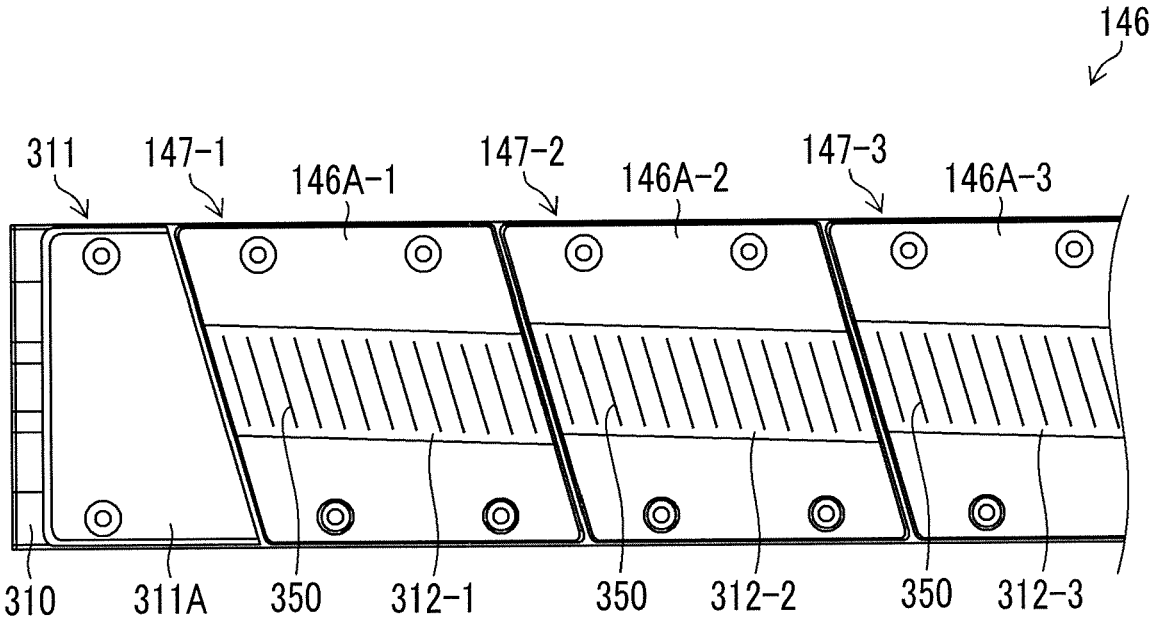
FIG. 3 is an enlarged view of a portion of a nozzle surface.

FIG. 3 is an enlarged view of a portion of the nozzle surface. The shape of a nozzle surface 146A-i of the head module 147-*i* is a parallelogram. Dummy plates 311 are attached to opposite ends of the supporting frame 310. The nozzle surface 146A of the liquid jetting head 146 has a rectangular shape as a whole to match the shapes of surfaces 311A of the dummy plates 311.

A central portion of the nozzle surface 146A-i of the head module 147-*i* is provided with a belt-shaped nozzle disposition portion 312-*i*. The nozzle disposition portion 312-*i* functions as the nozzle surface 146A-i, substantially. Nozzles are provided in the nozzle disposition portion 312-*i*.

Figure 5:
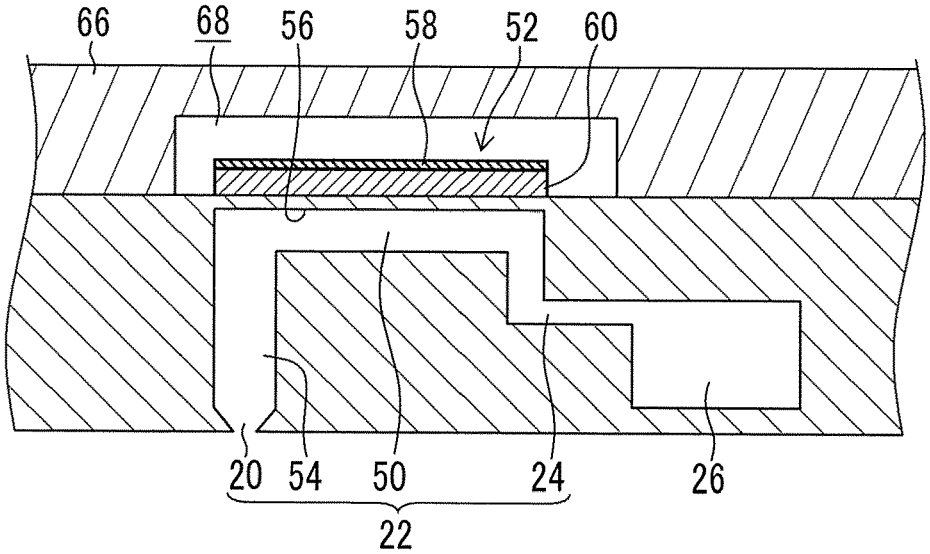
FIG. 5 is a cross sectional view illustrating the three-dimensional structure of an ejector.

In FIG. 3, the nozzles are not shown individually and nozzle arrays 350 composed of a plurality of nozzles are shown. The nozzle is shown in FIG. 5 and is given a reference symbol "20".

Figure 4:
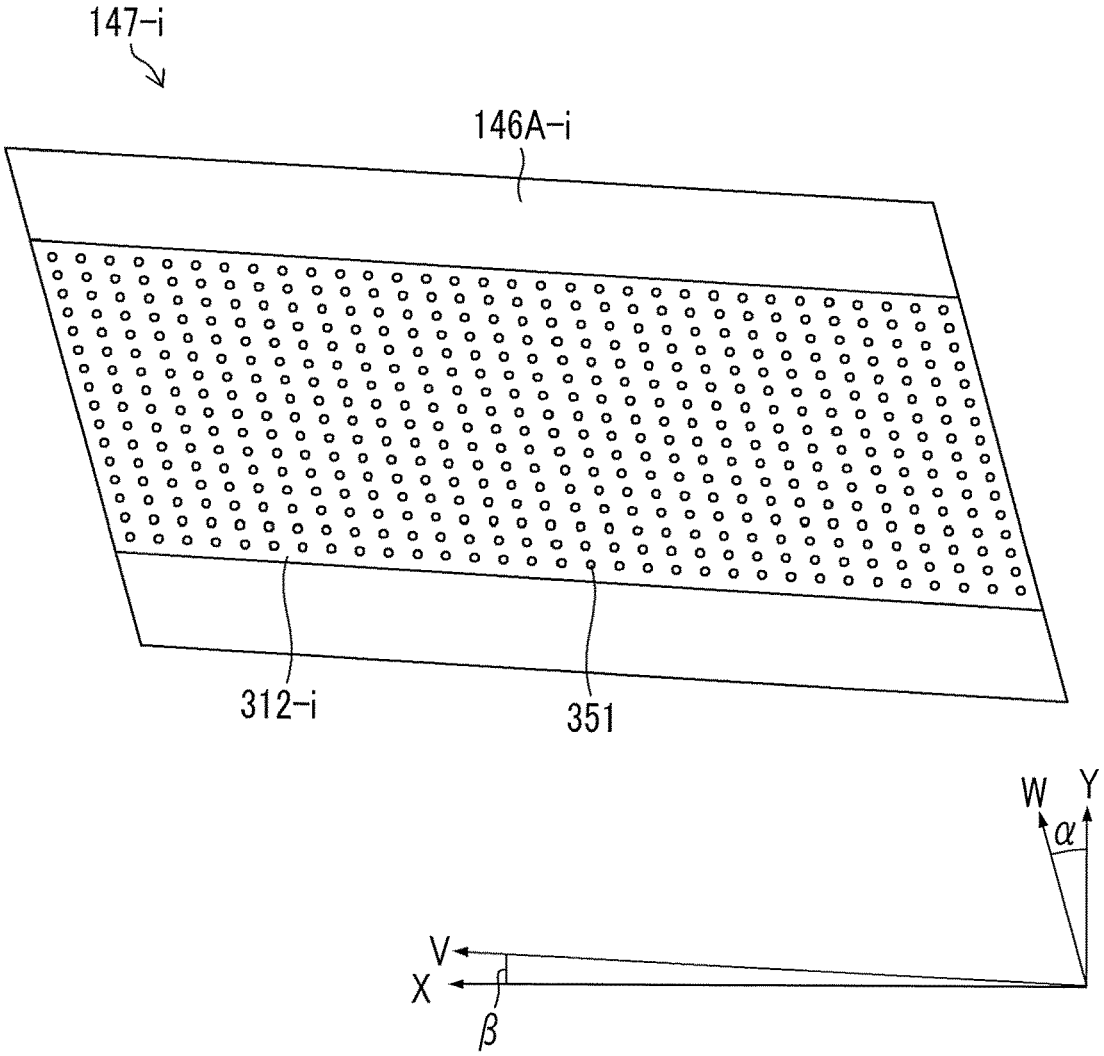
FIG. 4 is a plan view of a nozzle disposition portion.

FIG. 4 is a plan view of the nozzle disposition portion. A reference symbol "Y" represents the transportation direction of the paper P. "X" represents the width direction of the paper P. A plurality of nozzle openings 351 are disposed in the nozzle surface 146A-i of the head module 147-*i* and two-dimensional disposition is applied thereto.

The head module 147-*i* has a parallelogram-like planar shape having end surfaces on the side of the longer sides that extend along a V direction, which is inclined with respect to the width direction of the paper P at an angle β, and end surfaces on the side of the shorter sides that extend along a W direction, which is inclined with respect to the transportation direction of the paper P at an angle α.

In the head module 147-*i*, the plurality of nozzle openings 351 are disposed in a matrix with respect to a row direction parallel to the V direction and a column direction parallel to the W direction. The nozzle openings 351 may be disposed along a row direction parallel to the width direction of the paper P and a column direction obliquely intersecting the width direction of the paper P. The nozzle openings 351 in the present specification have the same meaning as nozzles.

In the case of a liquid jetting head in which a plurality of nozzles are arranged in a matrix, it can be considered that a projection nozzle array obtained by projecting the nozzles in the matrix arrangement along the width direction of the paper P is equivalent to one nozzle array in which the nozzles are arranged at approximately equal intervals at a nozzle density, at which the maximum recording resolution is achieved, with respect to the width direction of the paper P. The projection nozzle array is a nozzle array obtained by orthographic projection of the nozzles in two-dimensional nozzle arrangement along a nozzle array direction.

The meaning of being arranged at approximately equal intervals is being arranged at substantially equal intervals as jetting points at which recording can be performed in the ink jet printer. For example, in consideration of at least one of a manufacturing error or liquid droplets moving on a medium due to landing interference, a case where an interval slightly different from the other intervals is included is also included in the conception of being arranged at equal intervals. The projection nozzle array corresponds to a nozzle array substantially. In consideration of the projection nozzle array, it is possible to associate nozzle numbers representing nozzle positions with nozzles in accordance with the order in which projection nozzles arranged along the width direction of the paper P are arranged.

The way in which the nozzles of the liquid jetting head 146 are arranged is not limited and various ways of arranging the nozzles can be adopted. For example, instead of matrix-shaped two-dimensional arrangement, one-line linear arrangement, V-shaped nozzle arrangement, and folded-line-shaped nozzle arrangement such as W-shape arrangement of which the repeating unit is V-shape arrangement can also be adopted.

<Configuration of Ejector>

FIG. 5 is a cross sectional view illustrating the three-dimensional structure of an ejector. An ejector 22 comprises a nozzle 20, a pressure chamber 50 communicating with the nozzle 20, and a piezoelectric element 52. The nozzle 20 communicates with the pressure chamber 50 via a nozzle flow path 54. The pressure chamber 50 communicates with a supply side common tributary flow path 26 via an individual supply path 24. Note that, an opening of a distal end of the nozzle 20 corresponds to the nozzle opening 351 shown in FIG. 4.

A vibration plate 56 constituting a top surface of the pressure chamber 50 comprises a conductive layer functioning as a common electrode corresponding to a lower electrode of the piezoelectric element 52. Note that, the conductive layer is not shown. The pressure chamber 50, wall portions of other flow path portions, and the vibration plate 56 can be manufactured by using silicon.

The material of the vibration plate 56 is not limited to silicon and the vibration plate 56 can also be formed of non-conductive material such as resin. The vibration plate 56 may be formed of metal material such as stainless steel such that the vibration plate serves as a common electrode as well.

With a structure in which the piezoelectric element 52 is laminated on the vibration plate 56, a piezoelectric unimorph actuator is configured. Drive voltage is applied to an individual electrode 58, which is an upper electrode of the piezoelectric element 52, such that a piezoelectric substance 60 is deformed, the vibration plate 56 is bent, and the volume of the pressure chamber 50 is changed. A change in pressure accompanied by the change in volume of the pressure chamber 50 acts on ink and the ink is jetted from the nozzle 20.

In a case where the piezoelectric element 52 returns to the original state after the ink is jetted, the pressure chamber 50 is filled with new ink from the supply side common tributary flow path 26 and the individual supply path 24. An operation in which the pressure chamber 50 is filled with ink is called refilling.

The shape of the pressure chamber 50 s seen in a plan view is not particularly limited and various shapes such as a quadrangular shape, polygonal shapes other than a quadrangular shape, a circular shape, and an elliptical shape can be adopted. A constituent element shown in FIG. 5 to which a reference symbol "66" is given is a cover plate. The cover plate 66 is a member for securing a movable space 68 for the piezoelectric element 52 and seals the vicinity of the piezoelectric element 52.

A supply side ink chamber and a recovery side ink chamber (which are not shown) are formed above the cover plate 66. The supply side ink chamber is connected to a supply side common main flow path (not shown) via a communication path (not shown). The recovery side ink chamber is connected to a recovery side common main flow path (not shown) via a communication path (not shown).

[Maintenance Device]

<Outline>

Figure 7:
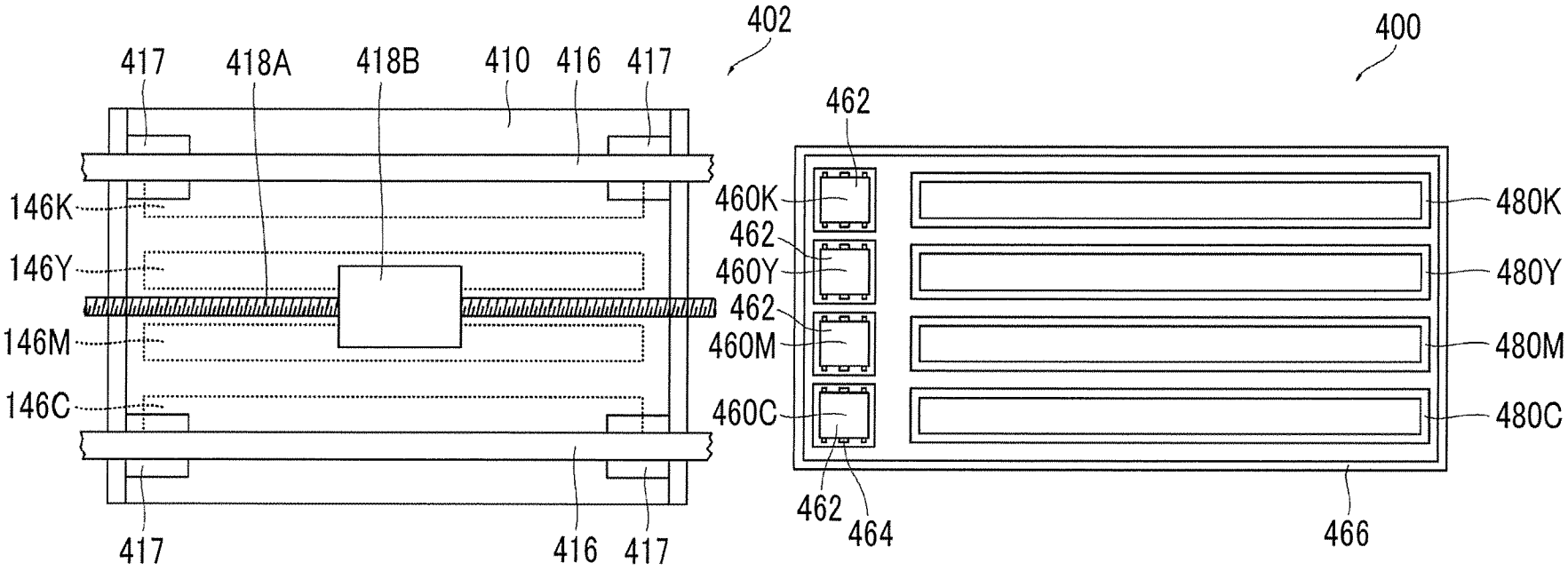
FIG. 7 is a plan view schematically illustrating the schematic configuration of the maintenance device.

FIG. 6 is a front view schematically illustrating a schematic configuration of the maintenance device. FIG. 7 is a plan view schematically illustrating the schematic configuration of the maintenance device. The maintenance device 400 performs maintenance of the liquid jetting head 146C, the liquid jetting head 146M, the liquid jetting head 146Y, and the liquid jetting head 146K shown in FIG. 7.

Note that, in FIG. 6, only the liquid jetting head 146C, which is one of the liquid jetting head 146C, the liquid jetting head 146M, the liquid jetting head 146Y, and the liquid jetting head 146K shown in FIG. 7, is shown.

In the following description, in a case where there is description about the liquid jetting head without a reference symbol given thereto, the "liquid jetting head" means any of the liquid jetting head 146C, the liquid jetting head 146M, the liquid jetting head 146Y, or the liquid jetting head 146K or is a generic term for all of the liquid jetting head 146C, the liquid jetting head 146M, the liquid jetting head 146Y, and the liquid jetting head 146.

The term "nozzle surface" means a nozzle surface of any of the liquid jetting head 146C, the liquid jetting head 146M, the liquid jetting head 146Y, or the liquid jetting head 146K. The nozzle surface herein means the nozzle disposition portion 312-*i* shown in FIG. 3, substantially.

The maintenance device 400 is installed adjacent to the drawing unit 140. In a case where maintenance of the liquid jetting head is performed, the liquid jetting head is moved to a position at which the liquid jetting head is mounted into a cap. Therefore, the maintenance device 400 comprises a head moving mechanism 402 that moves the liquid jetting head.

The cap includes a cap 480C, a cap 480M, a cap 480Y, and a cap 480K shown in FIG. 7. In FIG. 6, only the cap 480C shown in FIG. 7 is shown. Hereinafter, in a case where there is description about the cap without a reference symbol given thereto, the "cap" means any one of the cap 480C, the cap 480M, the cap 480Y, or the cap 480K shown in FIG. 7 or is a generic term for all of the cap 480C, the cap 480M, the cap 480Y, and the cap 480K.

<Head Moving Mechanism>

The head moving mechanism 402 comprises a head supporting frame 410 supporting the liquid jetting heads and a frame transporting device 412 that transports the head supporting frame 410. The head supporting frame 410 supports opposite end portions of each liquid jetting head in a longitudinal direction and supports each liquid jetting head such that each liquid jetting head becomes parallel to the rotary shaft of the drawing drum 142. Note that, the rotary shaft of the drawing drum 142 is not shown.

The head supporting frame 410 comprises a pair of head supporting portions 414 supporting the opposite end portions of each liquid jetting head in the longitudinal direction. The head supporting portions 414 are provided for each liquid jetting head. The head supporting portions 414 are disposed at certain intervals on a concentric circle centering on the rotary shaft of the drawing drum 142.

The head moving mechanism 402 comprises a head raising and lowering unit that raises and lowers the liquid jetting head. The head raising and lowering unit raises and lowers the head supporting portions 414 for each liquid jetting head along a vertical direction such that each liquid jetting head is raised and lowered in the vertical direction.

The frame transporting device 412 transports the head supporting frame 410 along the longitudinal direction of the liquid jetting head. The frame transporting device 412 is configured to comprise a pair of guide rails 416 and the sending device 418.

The pair of guide rails 416 is horizontally disposed to be parallel to the rotary shaft of the drawing drum 142. The head supporting frame 410 is slidably supported by the guide rails 416 with sliders 417 interposed therebetween.

The sending device 418 comprises a sending screw 418A, a nut member 418B screwed onto the sending screw 418A, and a motor 418C that rotates the sending screw 418A. The sending screw 418A is horizontally disposed to be parallel to the rotary shaft of the drawing drum 142. The sending screw 418A is disposed between the pair of guide rails 416.

The nut member 418B is screwed onto the sending screw 418A. The nut member 418B is connected to the head supporting frame 410. Accordingly, the head supporting frame 410 is moved along the guide rails 416 in a case where the sending screw 418A is rotated.

The motor 418C drives the sending screw 418A. In a case where the motor 418C is rotated forward, the head supporting frame 410 is moved from the drawing drum 142 to the cap along the guide rails 416. In a case where the motor 418C is rotated reversely, the head supporting frame 410 is moved from the cap to the drawing drum 142 along the guide rails 416.

The head moving mechanism 402 configured as described drives the motor 418C such that the liquid jetting head is moved along the longitudinal direction of the liquid jetting head which is a horizontal direction. In addition, the head raising and lowering unit (not shown) is operated such that the liquid jetting head is moved in the vertical direction. Movement of the liquid jetting head performed by means of the head moving mechanism 402 is controlled by using a control unit (not shown).

Examples of maintenance performed by using the maintenance device include moisture retention of the nozzle surface of the liquid jetting head and dummy jetting of the liquid jetting head.

A reference symbol "466" in FIG. 6 represents a waste liquid tray. A reference symbol "467" represents a waste liquid recovery pipe. A reference symbol "468" represents a waste liquid tank. A reference symbol "480C" represents a cap corresponding to the liquid jetting head 146C. A reference symbol "460C" represents a wiping unit wiping the nozzle surface of the liquid jetting head 146C.

<Wiping Unit>

As shown in FIG. 7, the maintenance device 400 comprises the wiping unit 460C, a wiping unit 460M, a wiping unit 460Y, and a wiping unit 460K. The wiping unit 460C is disposed on a moving route of the liquid jetting head 146C which moves in the horizontal direction. The wiping unit 460M, the wiping unit 460Y, and the wiping unit 460K are disposed in the same manner as above.

The wiping unit 460C causes a wiping web 462 to come into contact with the nozzle surface of the liquid jetting head 146C, which moves in a direction which is a horizontal direction and is parallel to the longitudinal direction, such that the nozzle surface of the liquid jetting head 146C is wiped.

The wiping unit 460C causes the wiping web 462 to travel at a certain speed by using a traveling device (not shown). The wiping unit 460C presses the wiping web 462, which travels by using a pressing roller 464, against the nozzle surface of the liquid jetting head 146C such that the nozzle surface of the liquid jetting head 146C is wiped.

The wiping unit 460C applies cleaning liquid to the wiping web 462 by using a cleaning liquid applying device (not shown). With the cleaning liquid applied to the wiping web 462, wet wiping of the nozzle surface of the liquid jetting head 146C is realized. In addition, it is possible to remove a substance adhering to the nozzle surface of the liquid jetting head 146C by using a cleaning function of the cleaning liquid. The same applies to the wiping unit 460M, the wiping unit 460Y, and the wiping unit 460K. Instead of the wiping web 462, another type of wiping member such as a blade may also be provided.

<Cap>

As shown in FIG. 7, the maintenance device 400 comprises the cap 480C, the cap 480M, the cap 480Y, and the cap 480K. The cap 480C seals the nozzle surface of the liquid jetting head 146C by covering a distal end portion of the liquid jetting head 146C.

The cap 480C is disposed at a position on a side opposite to the wiping unit 460C of the drawing drum 142 in a direction in which the liquid jetting head 146C is moved. The same applies to the cap 480M, the cap 480Y, and the cap 480K.

As shown in FIG. 7, the waste liquid tray 466 is provided below the wiping unit 460C, the wiping unit 460M, the wiping unit 460Y, the wiping unit 460K, the cap 480C, the cap 480M, the cap 480Y, and the cap 480K.

The wiping unit 460C, the wiping unit 460M, the wiping unit 460Y, the wiping unit 460K, the cap 480C, the cap 480M, the cap 480Y, and the cap 480K are installed inside the waste liquid tray 466.

The waste liquid tray 466 is connected with the waste liquid tank 468 via the waste liquid recovery pipe 467. Moisture retention liquid supplied to the cap 480C, the cap 480M, the cap 480Y, and the cap 480K, ink purged into the cap 480C, the cap 480M, the cap 480Y, and the cap 480K, or the like is discharged to the waste liquid tray 466 and is recovered by the waste liquid tank 468.

Figure 8:
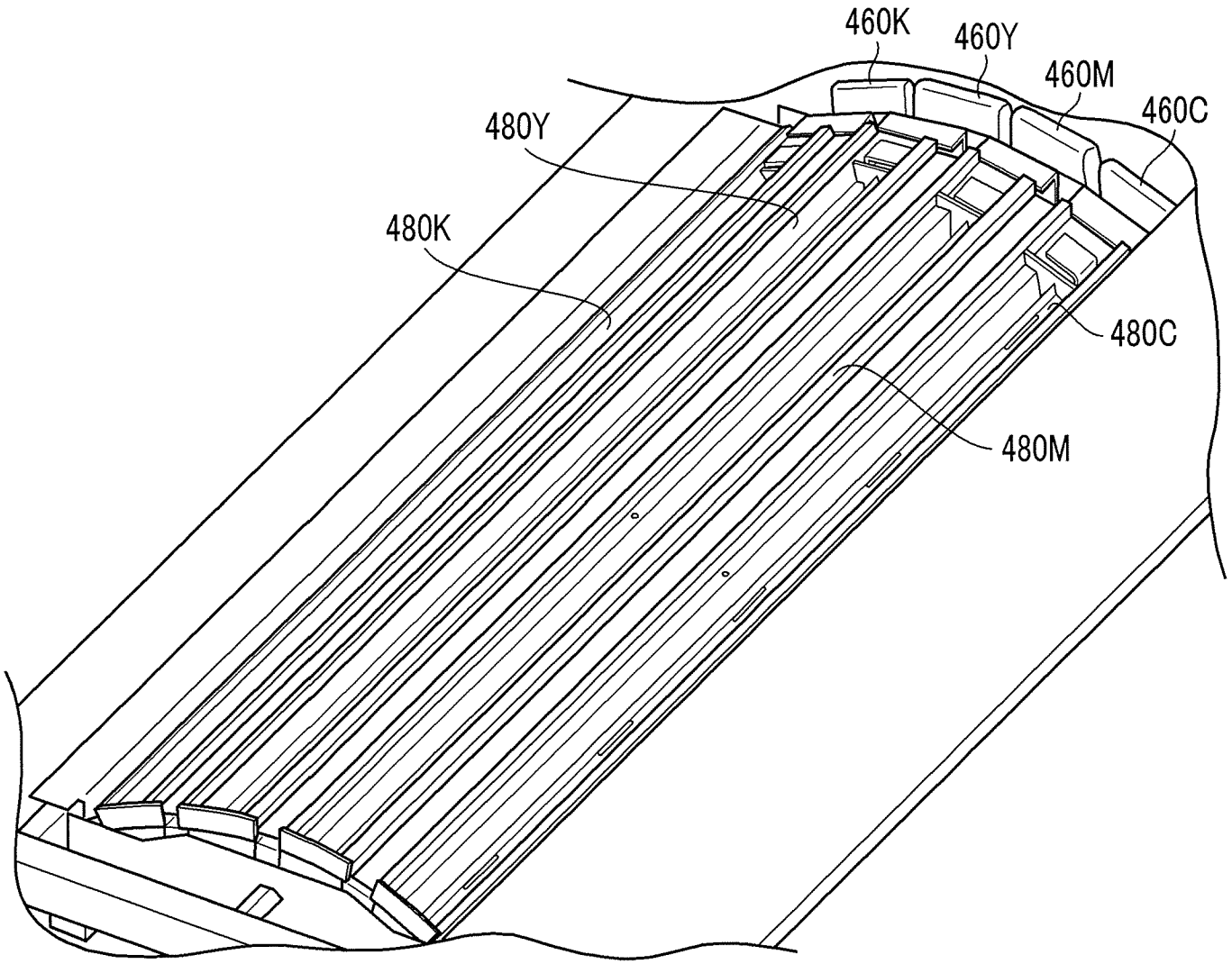
FIG. 8 is a perspective view illustrating the configuration of a cap.

FIG. 8 is a perspective view illustrating the configuration of the cap. Since the liquid jetting head 146C shown in FIG. 1 is disposed such that the nozzle surface thereof becomes inclined with respect to the horizontal plane, the cap 480C is disposed to be inclined with respect to the horizontal plane as shown in FIG. 8 in accordance with the nozzle surface of the liquid jetting head 146C. The same applies to the cap 480M, the cap 480Y, and the cap 480K. The configurations of the cap 480C, the cap 480M, the cap 480Y, and the cap 480K will be described in detail below.

<Details of Cap>

The cap 480C, the cap 480M, the cap 480Y, and the cap 480K shown in FIGS. 7 and 8 will be described in detail. Note that, the same structure is applied to the cap 480C, the cap 480M, the cap 480Y, and the cap 480K. Hereinafter, any one of the cap 480C, the cap 480M, the cap 480Y, or the cap 480K will be described as the cap 480.

Figure 9:
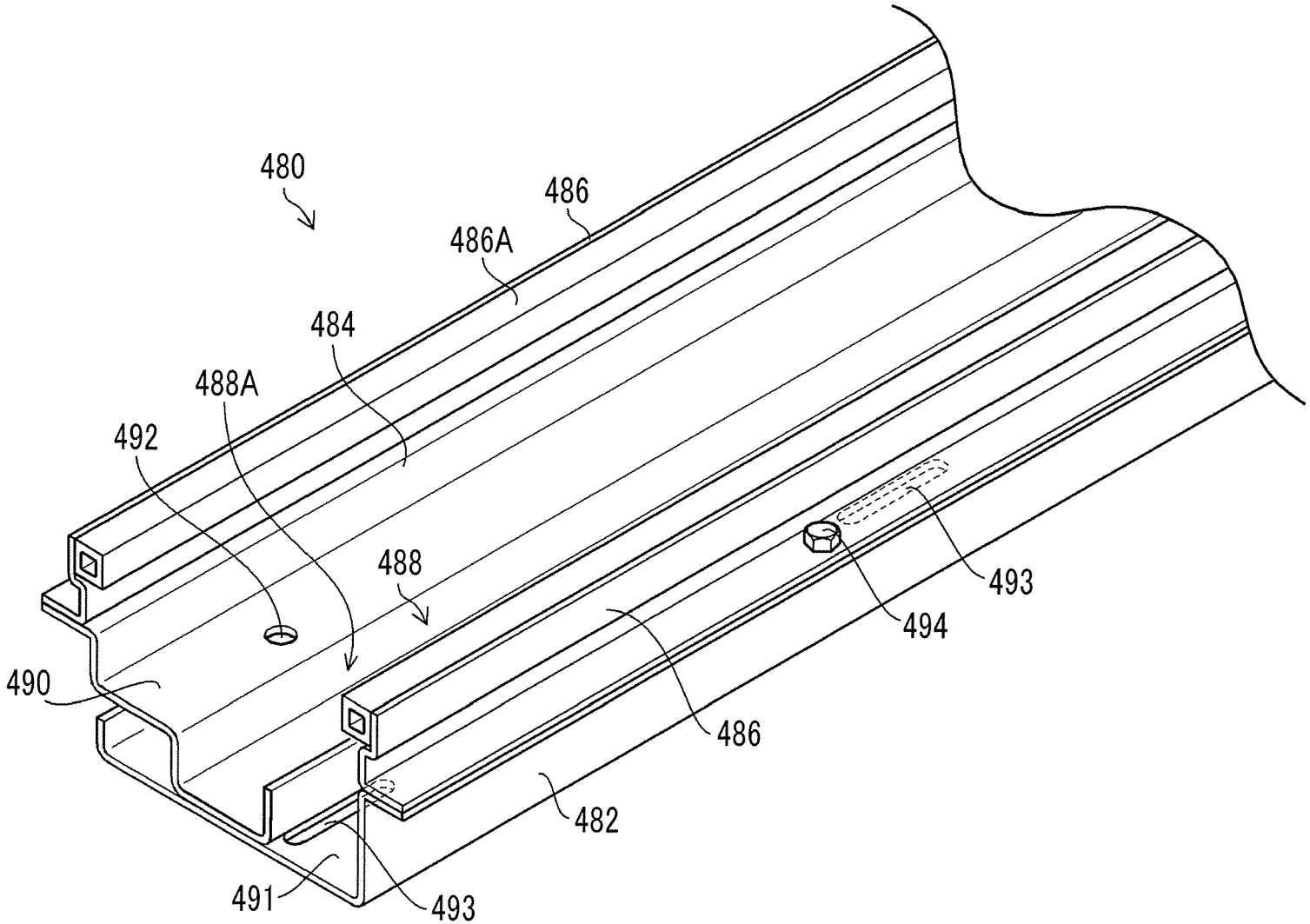
FIG. 9 is an enlarged view of a portion of the cap shown in FIG. 8.

FIG. 9 is an enlarged view of a portion of the cap shown in FIG. 8. The cap 480 mainly comprises a cap main body 482 and a sealing member 486 that is disposed along an opening portion 484 of the cap main body 482.

The cap main body 482 is formed as a housing of which an upper surface is provided with the opening portion 484. The upper surface of the cap main body 482 is a surface into which the liquid jetting head is inserted in a case where the liquid jetting head is mounted into the cap 480.

The cap main body 482 is configured to be able to accommodate a distal end portion of the liquid jetting head. The cap main body 482 is configured as an elongated housing to match the liquid jetting head configured as an elongated line head.

A liquid retention portion 488 for storing moisture retention liquid is provided inside the cap main body 482. The liquid retention portion 488 is configured as a housing of which an upper surface is provided with an opening portion 488A. The upper surface of the liquid retention portion 488 is a surface that faces the nozzle surface of the liquid jetting head in a case where the liquid jetting head is mounted into the cap. The liquid retention portion 488 is disposed along a longitudinal direction of the cap main body 482.

The cap 480 comprises an upper stage portion 490 that is positioned on an upper side of a slope with respect to the liquid retention portion 488 and a lower stage portion 491 that is positioned on a lower side of the slope with respect to the liquid retention portion 488. The upper stage portion 490 is composed of a surface of which the height is substantially equal to that of an upper edge portion of the liquid retention portion 488. The lower stage portion 491 is composed of a surface of which the height is substantially equal to that of a bottom portion of the liquid retention portion 488.

The upper stage portion 490 comprises a plurality of moisture retention liquid supply ports 492 arranged along the longitudinal direction of the cap main body 482. In FIG. 9, one of the plurality of moisture retention liquid supply ports 492 is shown. A moisture retention liquid supply pipe (not shown) is connected to the moisture retention liquid supply ports 492. The moisture retention liquid supply pipe is connected to a moisture retention liquid supply device (not shown).

Moisture retention liquid supplied from the moisture retention liquid supply device flows into the cap main body 482 through the moisture retention liquid supply ports 492. The moisture retention liquid flowing into the cap main body 482 flows along the upper stage portion 490 and is stored in the liquid retention portion 488.

The lower stage portion 491 comprises a plurality of moisture retention liquid discharge ports 493 arranged along the longitudinal direction of the cap main body 482. Moisture retention liquid overflowing out of the liquid retention portion 488 and ink purged from the liquid jetting head are recovered by means of the lower stage portion 491 and are discarded through the moisture retention liquid discharge ports 493. The ink and the like discarded through the moisture retention liquid discharge ports 493 are recovered by the waste liquid tray 466 shown in FIGS. 6 and 7.

The sealing member 486 is configured as a frame body that has a quadrangular shape as a whole. The sealing member 486 is disposed along a peripheral edge of the opening portion 484 of the cap main body 482. The sealing member 486 is bonded to the cap main body 482 with a bolt 494.

The sealing member 486 comprises an elastic member 486A as a seal. In a case where the cap 480 is mounted on the liquid jetting head, the elastic member 486A comes into close contact with an outer periphery of the distal end portion of the liquid jetting head such that a gap formed between the cap 480 and the liquid jetting head is sealed. Rubber, a brush, and felt can be applied to the elastic member 486A. For the elastic member 486A, hollow silicon rubber subjected to fluorine coating is preferably used.

<Action of Cap>

In a case of mounting the cap 480 on the liquid jetting head, the liquid jetting head is moved from a position immediately above the drawing drum 142 to the position of the cap 480. The movement of the liquid jetting head in the case of mounting the cap on the liquid jetting head is controlled by means of a maintenance control unit, which is not shown.

The liquid jetting head disposed immediately above the drawing drum 142 is moved upward in the vertical direction and is moved to a withdrawal position which is separated from the circumferential surface of the drawing drum 142 by a predetermined distance. Examples of the distance between the circumferential surface of the drawing drum 142 and the withdrawal position include any distance falling in a range of 5.0 millimeters to 10.0 millimeters. Examples of the distance from the circumferential surface of the drawing drum 142 to the nozzle surface of the liquid jetting head in a case where a drawing operation is performed include any distance falling in a range of 0.5 millimeters to 2.0 millimeters.

The liquid jetting head moved to the withdrawal position is moved toward the cap 480 along a direction which is a horizontal direction and is parallel to the longitudinal direction of the liquid jetting head. In a case where the liquid jetting head reaches a position immediately above the cap 480, the liquid jetting head is stopped.

The liquid jetting head having reached the position immediately above the cap 480 is moved toward the cap 480. The distal end portion of the liquid jetting head is fitted into the sealing member 486 of the cap 480 and the liquid jetting head is stopped at a predetermined position.

In a case where the cap 480 is mounted on the liquid jetting head, the nozzle disposition portion 312-*i* of the nozzle surface 146A-i shown in FIG. 4 faces the opening portion 488A of the liquid retention portion 488 shown in FIG. 9. In addition, in a case where the cap 480 is mounted on the liquid jetting head, the nozzle surface 146A-i is sealed by means of the cap 480. Accordingly, it is possible to perform moisture retention of the nozzle surface 146A-i by means of moisture retention liquid stored in the cap 480.

[Description about Liquid Retention Portion According to First Embodiment]

Figure 10:
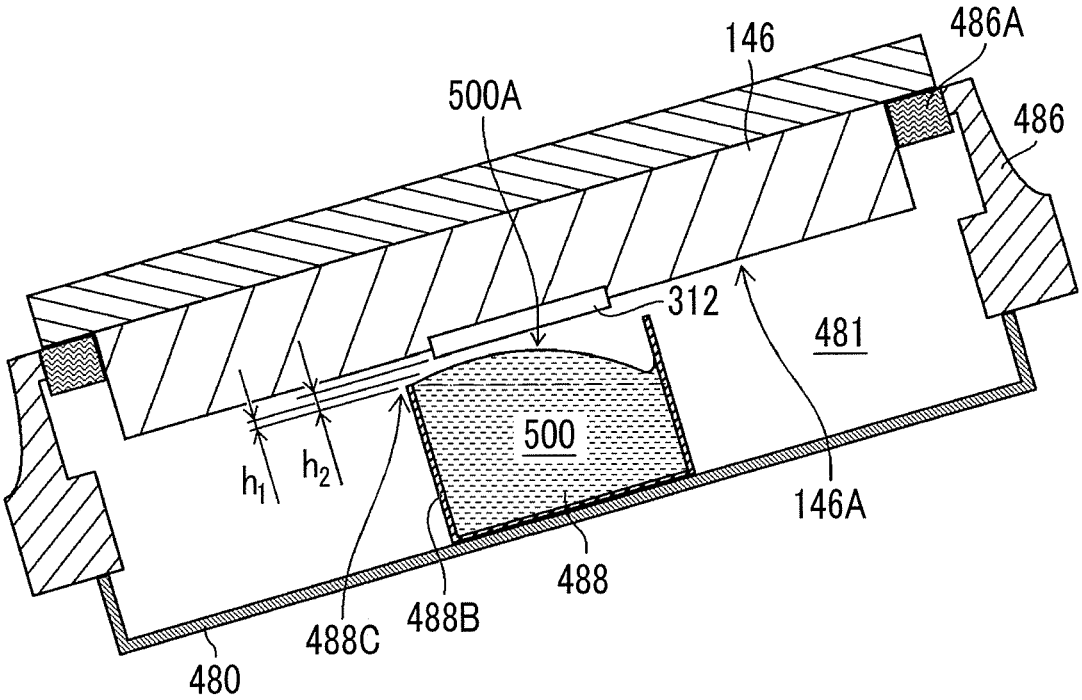
FIG. 10 is a sectional view illustrating a state where the cap is mounted on the liquid jetting head.

FIG. 10 is a sectional view illustrating a state where the cap is mounted on the liquid jetting head. FIG. 10 is a sectional view illustrating a state where the cap 480 is mounted on the liquid jetting head 146. A direction penetrating the paper surface of FIG. 10 is the longitudinal direction of the liquid jetting head 146. A reference symbol "481" represents a closed space formed between the liquid jetting head 146 and the cap 480.

As shown in FIG. 10, a liquid surface 500A of moisture retention liquid 500 stored in the liquid retention portion 488 may swell due to the surface tension of the moisture retention liquid such that the height thereof exceeds the height of an upper surface 488C of a liquid retention wall 488B which is on a lower side of a slope.

A reference symbol "$h_1$" in FIG. 10 represents the height of swelling of the moisture retention liquid 500. The height of swelling $h_1$ of the moisture retention liquid 500 is the maximum value of a distance from the upper surface 488C of the liquid retention wall 488B to the liquid surface 500A of the moisture retention liquid 500.

A reference symbol "$h_2$" represents a clearance between the liquid retention portion 488 and the nozzle disposition portion 312. The clearance between the liquid retention portion 488 and the nozzle disposition portion 312 is a distance from the upper surface 488C of the liquid retention wall 488B to the nozzle disposition portion 312. Examples of the clearance $h_2$ between the liquid retention portion 488 and the nozzle disposition portion 312 include an area of 2.0 plus or minus 0.68 millimeters.

In a case where the liquid surface 500A of the moisture retention liquid 500 comes into contact with the nozzle disposition portion 312 of the nozzle surface 146A, a bridge of the moisture retention liquid 500 may be generated between the liquid surface 500A of the moisture retention liquid 500 and the nozzle disposition portion 312 of the nozzle surface 146A may be bridged by the moisture retention liquid 500. In this case, there is a possibility of deterioration in jetting state of the liquid jetting head 146 after detachment of the cap 480.

In a case where a distance between the nozzle surface 146A and the liquid retention portion 488 is increased in order to prevent the bridge of the moisture retention liquid 500 from being generated, there is a possibility of problems as follows. In a case where the liquid surface 500A of the moisture retention liquid 500 does not swell or in a case where the amount of moisture retention liquid is decreased due to evaporation of the moisture retention liquid, the moisture retention performance with respect to the nozzle is decreased and thus the nozzle is dried. In this case, there is a possibility of deterioration in jetting state of the liquid jetting head 146 after detachment of the cap 480.

Therefore, in the case of the cap 480 in the present embodiment, an overflow starting point is formed on an upper portion of the liquid retention wall 488B constituting the liquid retention portion 488 for the purpose of maintaining a distance between the liquid surface 500A of the moisture retention liquid 500 and the nozzle surface in a certain range. In FIG. 10, the overflow starting point is not shown. The upper portion of the liquid retention wall 488B includes the upper surface 488C of the liquid retention wall 488B.

As shown in FIG. 10, the liquid jetting head 146 is disposed such that the nozzle surface 146A is inclined with respect to the horizontal plane. The angle of inclination of the nozzle surface of the liquid jetting head 146M and the nozzle surface of the liquid jetting head 146Y shown in FIG. 1 with respect to the horizontal plane is 8 degrees. The angle of inclination of the nozzle surface of the liquid jetting head 146C and the nozzle surface of the liquid jetting head 146K with respect to the horizontal plane is 24 degrees.

The surface tension of the moisture retention liquid 500 may be equal to or greater than 25 millinewton meters and equal to or smaller than 75 millinewton meters. The moisture retention liquid 500 may include ink discharged during dummy jetting or the like. A value measured by a surface tension balance can be applied to the surface tension of the moisture retention liquid 500.

Figure 11:
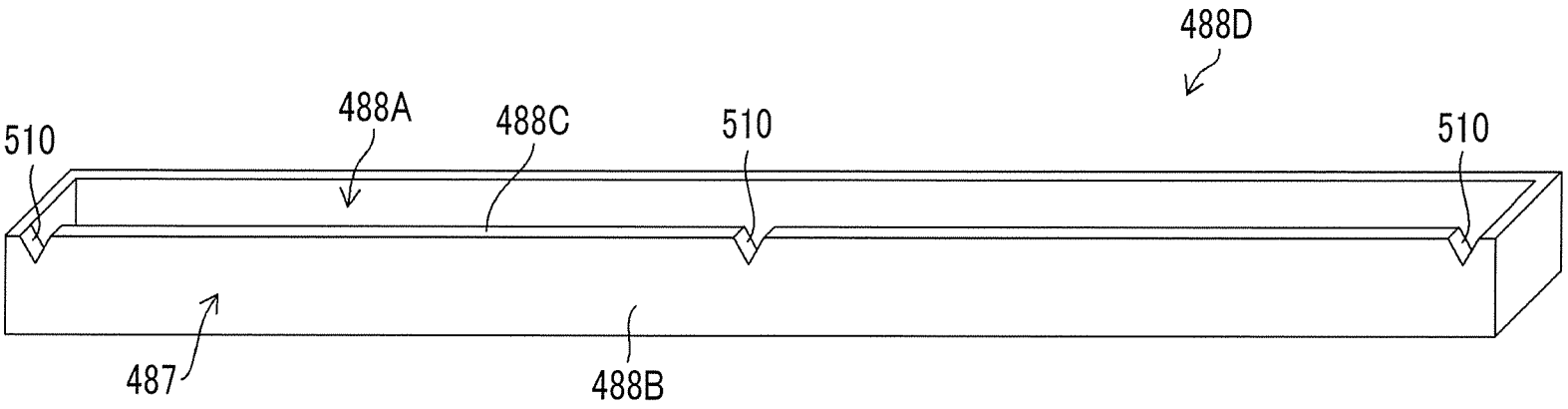
FIG. 11 is a perspective view illustrating an example of the structure of a liquid retention portion according to a first embodiment.

FIG. 11 is a perspective view illustrating an example of the structure of the liquid retention portion according to the first embodiment. In FIG. 11, the moisture retention liquid 500 is not shown. In the case of a liquid retention portion 488D shown in FIG. 11, one or a plurality of overflow starting points 510 are formed on the upper surface 488C of the liquid retention wall 488B. Note that, a ratio between dimensions of the liquid retention portion, the overflow starting point, or the like shown in the following drawings is approximately increased or decreased for the sake of convenience of illustration.

The overflow starting point 510 shown in FIG. 11 is a groove formed on the liquid retention wall 488B along a longitudinal direction of the liquid retention portion 488D and is a through-groove that penetrates the liquid retention wall 488B in a thickness direction. The thickness direction may include a direction inclined with respect to the thickness of the liquid retention wall 488B. The planar shape of the overflow starting point 510 on a side surface 487 of the liquid retention wall 488B of the liquid retention portion 488D is a triangular shape. As the triangular shape, any triangular shape such as an equilateral triangle and an isosceles triangle can be applied. Examples of the triangular shape herein include a shape with a rounded vertical angle, which is not a triangular shape in the strict sense but can be considered as a triangular shape substantially. The same applies to quadrangular shapes and polygonal shapes as follows.

The width of the overflow starting point 510 may be equal to or greater than 2.0 millimeters and equal to or smaller than 3.0 millimeters. The depth of the overflow starting point 510 may be equal to or greater than 1.0 millimeters and equal to or smaller than 2.0 millimeters.

The width of the overflow starting point 510 herein is the maximum value of the length of the overflow starting point 510 in the longitudinal direction of the liquid retention portion 488D. In a case where the planar shape is a triangular shape, the width of the overflow starting point 510 corresponds to the length of the bottom of the triangular shape. In addition, in a case where the planar shape is a triangular shape, the depth of the overflow starting point 510 corresponds to the length of the height of the triangular shape.

The liquid retention portion 488 shown in FIG. 11 is an example of a liquid retention portion that has a rectangular parallelepiped shape of which the length in a first direction is longer than the length in a second direction orthogonal to the first direction. The rectangular parallelepiped may not be a rectangular parallelepiped in the strict sense and may be a substantially rectangular parallelepiped. For example, a structure such as a projection and a hole may be formed on an outer periphery.

The same applies to the liquid retention portions shown in FIGS. 12 to 22. The longitudinal direction of the liquid retention portion 488D is an example of the first direction. The liquid retention wall 488B along the longitudinal direction of the liquid retention portion 488D is an example of a first wall.

FIG. 11 shows the liquid retention portion 488D, of which three overflow starting points 510 are formed in the longitudinal direction of the liquid retention portion 488D. However, it is sufficient that at least one overflow starting point 510 is formed. That is, the number of overflow starting points 510 may be one or more.

FIG. 11 shows the liquid retention portion 488D, of which the overflow starting points 510 are formed at opposite ends and the central portion of the liquid retention portion 488D in the longitudinal direction. However, the overflow starting points 510 may be formed at any positions in the longitudinal direction of the liquid retention portion 488D. The number of overflow starting points 510 and the positions thereof can be determined based on a condition that the height of swelling of the liquid surface 500A of the moisture retention liquid 500 shown in FIG. 10 falls in a desired height range.

In a case where the cap comprising the liquid retention portion 488 is disposed to inclined in accordance with the liquid jetting head disposed to be inclined, the overflow starting point 510 may be formed on a liquid retention wall on a lower side of a slope and may be formed on a liquid retention wall on an upper side of the slope.

Modification Example

Figure 12:
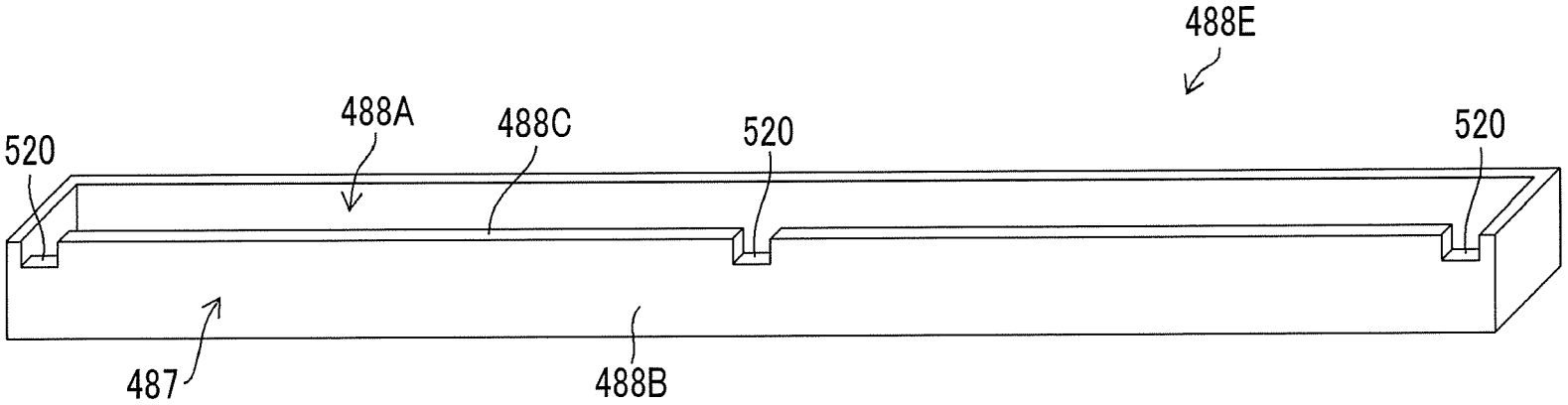
FIG. 12 is a perspective view illustrating an example of the structure of a liquid retention portion according to a modification example of the first embodiment.

FIG. 12 is a perspective view illustrating an example of the structure of a liquid retention portion according to a modification example of the first embodiment. In the case of a liquid retention portion 488E shown in FIG. 12, an overflow starting point 520 of which the planar shape on the side surface 487 of the liquid retention wall 488B is a quadrangular shape is formed. The shape of the overflow starting point 520, the number of overflow starting points 520, and the disposition of the overflow starting point 520 are the same as those of the overflow starting point 510 shown in FIG. 11.

As the planar shape of the overflow starting point 520, any quadrangular shape such as a square or a rectangle can be applied. The same applies to an overflow starting point 540 shown in FIG. 20.

Figure 13:
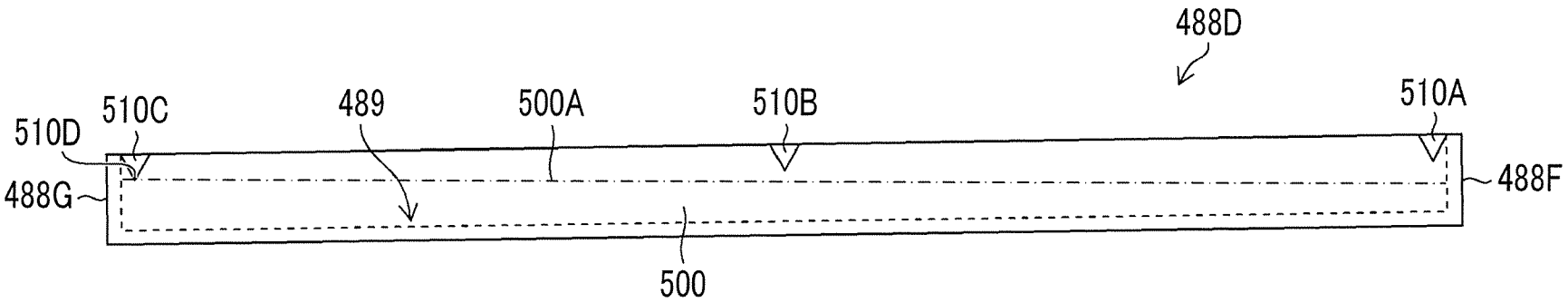
FIG. 13 is a schematic view illustrating a positional relationship between an overflow starting point and a liquid surface of moisture retention liquid made in a case where the levelness error of attachment of the cap in a longitudinal direction of the cap is great.

FIG. 13 is a schematic view illustrating a positional relationship between an overflow starting point and a liquid surface of moisture retention liquid made in a case where the levelness error of attachment of the cap in the longitudinal direction of the cap is great. FIG. 13 is a see-through plan view of the liquid retention wall 488B shown in FIG. 11. The length of the liquid retention portion 488D in the longitudinal direction corresponds to the entire length of the liquid jetting head in the longitudinal direction. For example, the length of the liquid retention portion 488D in the longitudinal direction may be equal to or greater than 1000 millimeters.

Accordingly, in a case where the levelness error of a cap 480D in the longitudinal direction shown in FIG. 13 is great, for example, in a case where the number of overflow starting points is one since only an overflow starting point 510A is formed and an overflow starting point 510B and an overflow starting point 510C are not formed, it may be difficult to discharge the moisture retention liquid 500 in the liquid retention portion 488D.

A case where the liquid retention portion 488D shown in FIG. 13 is downwardly inclined from one end portion 488F in the longitudinal direction to the other end portion 488G in the longitudinal direction will be considered. Since the position of the liquid surface 500A of the moisture retention liquid 500 is lower than that of the overflow starting point 510A formed on the one end portion 488F in the longitudinal direction of the liquid retention portion 488D, the moisture retention liquid 500 does not flow over the overflow starting point 510A. The same applies to the overflow starting point 510B formed on the central portion in the longitudinal direction of the liquid retention portion 488D.

Meanwhile, the height of the liquid surface 500A of the moisture retention liquid 500 may exceed the height of a bottom portion 510D of the overflow starting point 510C formed on the one end portion 488F in the longitudinal direction of the liquid retention portion 488D. The height of the bottom portion 510D is the shortest distance from a bottom surface 489 of the liquid retention portion 488D to the bottom portion 510D of the overflow starting point 510C.

In a case where the height of the liquid surface 500A of the moisture retention liquid 500 exceeds the height of the bottom portion 510D of the overflow starting point 510C, the moisture retention liquid 500 overflows out of the liquid retention portion 488D through the overflow starting point 510C.

That is, a plurality of overflow starting points 510 are formed in the longitudinal direction of the liquid retention portion 488. Accordingly, even in case where the levelness error of the cap is great, the moisture retention liquid 500 overflows out of the liquid retention portion 488D through the overflow starting point 510C in a case where the height the liquid surface 500A of the moisture retention liquid 500 exceeds the height of the bottom portion 510D of the overflow starting point 510C. The plurality of overflow starting points 510 are preferably formed on at least opposite end portions in the longitudinal direction of the liquid retention portion 488. An end portion is a region including an end and means a region of a certain distance around an end that can be considered as an end substantially.

[Effect of Cap Comprising Liquid Retention Portion Provided with Overflow Starting Point]

Figure 14:
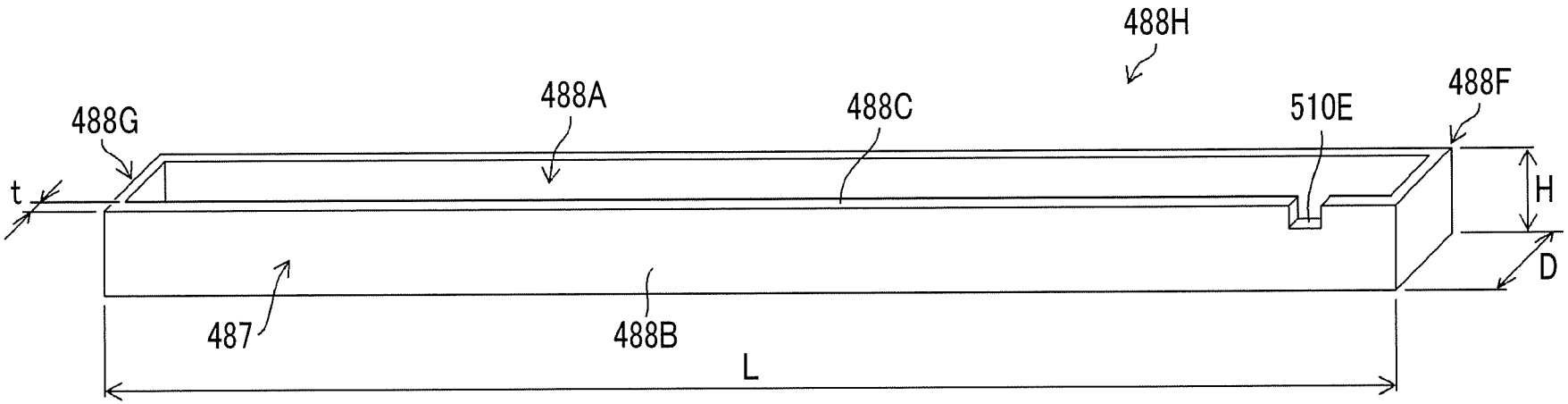
FIG. 14 is a perspective view illustrating the structure of a liquid retention portion provided with an overflow starting point that was used in an evaluation test about the liquid surface height of moisture retention liquid.

FIG. 14 is a perspective view illustrating the structure of a liquid retention portion provided with an overflow starting point that was used in an evaluation test about the liquid surface height of moisture retention liquid. The liquid surface height of moisture retention liquid was measured by using a liquid retention portion 488H shown in FIG. 14. The measurement conditions were as follows.

<Measurement Conditions>

The entire length L of the liquid retention portion 488H in a longitudinal direction was 1000 millimeters. The entire length D of the liquid retention portion 488H in a transverse direction was 10.0 millimeters. A height H of the liquid retention portion was 10.0 millimeters. A thickness t of the liquid retention wall 488B of the liquid retention portion 488H was 1.0 millimeters.

The position of an overflow starting point 510E was a position separated from the one end portion 488F in the longitudinal direction of the liquid retention portion 488H by 10.0 millimeters. The width of the overflow starting point 510E was 3.0 millimeters. The depth of the overflow starting point 510E was 1.5 millimeters.

Figure 15:
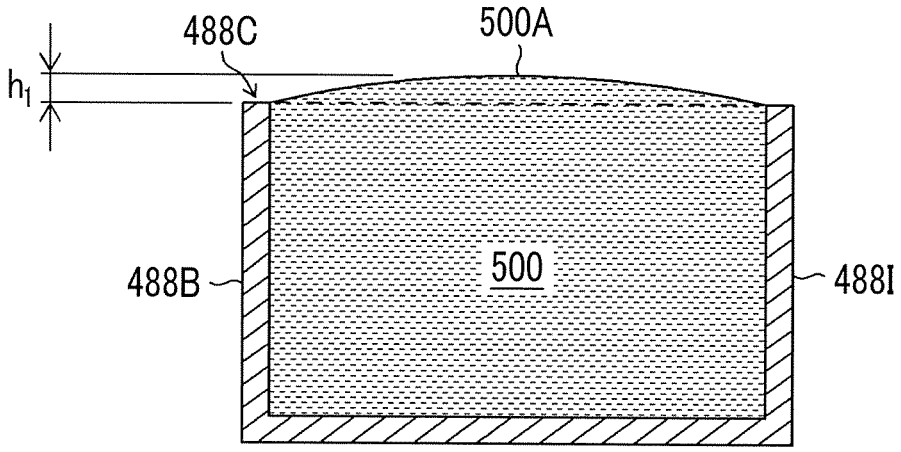
FIG. 15 is a sectional view schematically illustrating the liquid surface of moisture retention liquid in a case where the angle of inclination was 0 degrees and there was no overflow starting point.
Figure 17:
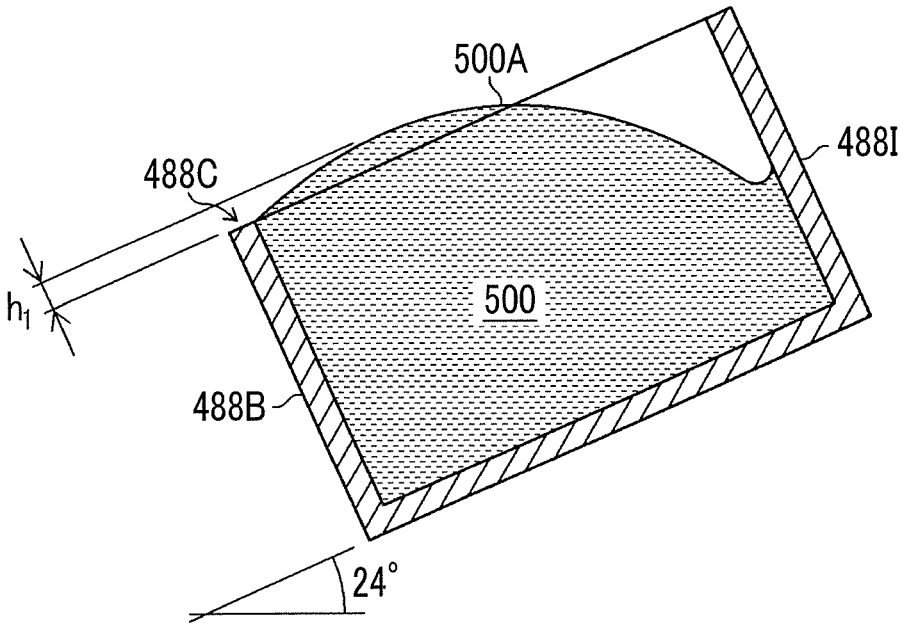
FIG. 17 is a sectional view schematically illustrating the liquid surface of moisture retention liquid in a case where the angle of inclination was 24 degrees and there was no overflow starting point.

In addition, for comparison with the liquid retention portion 488H shown in FIG. 14, a non-overflow starting point liquid retention portion in which no overflow starting point formed was used. The non-overflow starting point liquid retention portion is shown in FIGS. 15 and 17 and is given a reference symbol "488I".

As moisture retention liquid, moisture retention liquid as follows was used. The surface tension of the moisture retention liquid was 28.0 millinewton meters. The surface tension of the moisture retention liquid was a value measured by a surface tension balance.

<Moisture Retention Liquid>

As moisture retention liquid, liquid containing a moisture retention agent was applied. The moisture retention agent refers to a low-volatility water-soluble compound of which the water retention performance is relatively high. Examples of the moisture retention agent include polyols, lactams, and water-soluble solid moisture retention agent. It is possible to apply any moisture retention agent as long as the surface tension of the moisture retention liquid can be adjusted to fall in a predetermined range.

Examples of the polyols include glycerin, ethylene glycol, diethylene glycol, triethylene glycol, tetraethylene glycol, polyethylene glycol, propylene glycol, dipropylene glycol, polypropylene glycol, 1,3-propanediol, 1,4-butanediol, 1,5-pentanediol and pentaerythritol.

Examples of the lactams include 2-pyrrolidone and N-methyl-2-pyrrolidone. Examples of the water-soluble solid moisture retention agent include nitrogen compounds such as urea, thiourea, or N-ethylurea; diols such as 1,6-hexanediol, 1,8-octanediol, 2,2-dimethyl-1,3-propanediol, or 2,2-diethyl-1,3-propanediol; trimethylolethane, trimethylolpropane, or the like; monosaccharides, disaccharides, oligosaccharides, and polysaccharides, derivatives of any of these saccharides, such as reducing sugars, oxidized sugars, amino acids, or thiosugar, such as glucose, mannriose, fructose, ribose, xylose, arabinose, galactose, aldonic acid, glucitol (sorbitol), maltose, cellobiose, lactose, sucrose, trehalose, or maltotriose.

As the moisture retention liquid, polyols are preferable, glycerin, ethylene glycol, diethylene glycol, and triethylene glycol are more preferable, and diethylene glycol is most preferable.

The moisture retention agent content is preferably in a range of from 16% by mass to 30% by mass with respect to the entire moisture retention liquid. In a case where the moisture retention agent content is 16% by mass or higher, drying caused by evaporation of moisture of the moisture retention liquid is suppressed. In a case where the moisture retention agent content is 30% by mass or lower, a decrease in fluidity caused by an increase in viscosity is suppressed. The moisture retention agent content can be determined in the viewpoint of adjusting the surface tension to fall in a predetermined range.

<Method of Measuring Height of Swelling of Liquid Surface>

The height of swelling $h_1$ of the liquid surface 500A was derived in relation to a case where the caps 480 comprising the liquid retention portion 488H and the liquid retention portion 488I are disposed to be parallel to the horizontal plane and a case where the caps 480 comprising the liquid retention portion 488H and the liquid retention portion 488I are disposed to be inclined with respect to the horizontal plane by 24 degrees.

The height of swelling $h_1$ of the liquid surface 500A was calculated by subtracting a measured value of the position of the upper surface 488C of the liquid retention wall 488B from a measured value of the position of the liquid surface 500A. As the position of the liquid surface 500A, the largest value from among a plurality of measured values obtained through measurement performed with respect to a plurality of positions along the liquid surface 500A was used. The position of the liquid surface 500A and the position of the upper surface 488C of the liquid retention wall 488B were measured by using a non-contact type measurer.

In the present embodiment, the height of swelling $h_1$ of the liquid surface 500A in a normal direction of the nozzle surface of the liquid jetting head was derived. The normal direction of the nozzle surface of the liquid jetting head was a direction parallel to a short side of the liquid retention wall 488B.

<Result>

The result of the measurement is shown in Table 1.

TABLE 1

| Angle of Inclination [degrees] | Height of Swelling of Liquid Surface $h_1$ [mm] Without Overflowing Starting Point | With Overflowing Starting Point |
|---|---|---|
| 0 | 1.0 | 0.2 |
| 24 | 1.8 | 0 |

FIG. 15 is a sectional view schematically illustrating the liquid surface of the moisture retention liquid in a case where the angle of inclination was 0 degrees and there was no overflow starting point. As shown in Table 1, in a case where the angle of inclination was 0 degrees and there was no overflow starting point formed, the height of swelling $h_1$ of the liquid surface 500A was 1.0 millimeters.

Figure 16:
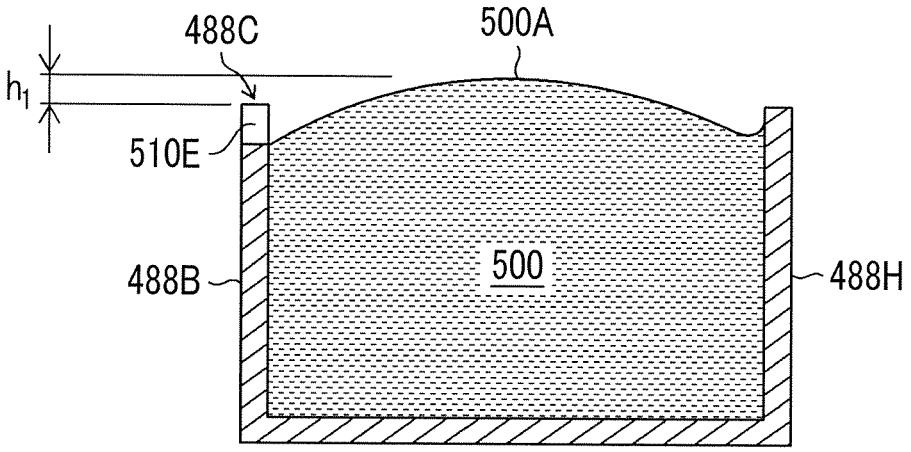
FIG. 16 is a sectional view schematically illustrating the liquid surface of moisture retention liquid in a case where the angle of inclination was 0 degrees and there was an overflow starting point.

FIG. 16 is a sectional view schematically illustrating the liquid surface of the moisture retention liquid in a case where the angle of inclination was 0 degrees and there was an overflow starting point. As shown in Table 1, in a case where the angle of inclination was 0 degrees and there was an overflow starting point, the height of swelling $h_1$ of the liquid surface 500A was 0.2 millimeters.

FIG. 17 is a sectional view schematically illustrating the liquid surface of the moisture retention liquid in a case where the angle of inclination was 24 degrees and there was no overflow starting point. As shown in Table 1, in a case where the angle of inclination is 24 degrees and there was no overflow starting point, the height of swelling $h_1$ of the liquid surface 500A was 1.8 millimeters.

Figure 18:
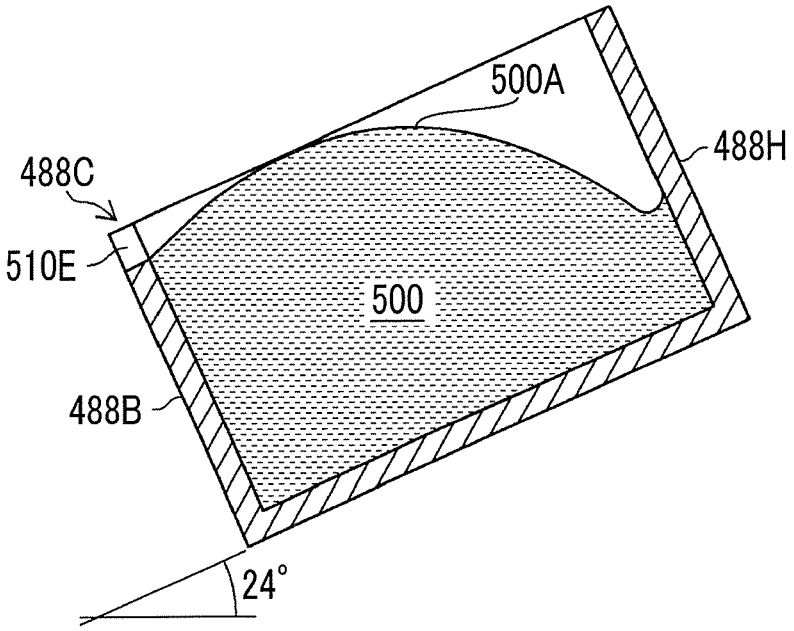
FIG. 18 is a sectional view schematically illustrating the liquid surface of moisture retention liquid in a case where the angle of inclination was 24 degrees and there was an overflow starting point.

FIG. 18 is a sectional view schematically illustrating the liquid surface of the moisture retention liquid in a case where the angle of inclination was 24 degrees and there was an overflow starting point. As shown in Table 1, in a case where the angle of inclination was 24 degrees and there was an overflow starting point, the height of swelling $h_1$ of the liquid surface 500A was 0 millimeters. Note that, in FIG. 18, $h_1$ is not shown since $h_1$ is 0 millimeters.

As shown in Table 1, in a case where there was no overflow starting point and the angle of inclination was 24 degrees, the height of swelling of the liquid surface was high in comparison with a case where the angle of inclination is 0 degrees. Meanwhile, in a case where there was an overflow starting point, the height of swelling of the liquid surface was approximately the same for both of a case where the angle of inclination was 0 degrees and a case where the angle of inclination was 24 degrees. In addition, the height of swelling of the liquid surface could be suppressed to be equal to or smaller than 0.2 millimeters.

As a result, it can be considered that the same result as that in a case where the angle of inclination is 0 degrees and a case where the angle of inclination is 24 degrees is obtained for any of angles of inclination from 0 degrees to 24 degrees. In addition, it can be considered that the same result as that in a case where the angle of inclination is 0 degrees and a case where the angle of inclination is 24 degrees is obtained even in a case where the angle of inclination exceeds 24 degrees.

In addition, it can be considered that the same test result as described above can be obtained for any moisture retention liquid of which the value of the surface tension is approximately the same. Furthermore, it can be considered that it is difficult for the liquid surface to swell in a case where the value of the surface tension is small. Therefore, it can be considered that the same test result as described above can be obtained for moisture retention liquid with any surface tension equal to or smaller than 28 millinewton meters.

Furthermore, it can be considered that the same test result as described above can be obtained for moisture retention liquid with any surface tension practically used in a case where the disposition, the shape, and the like of an overflow starting point is appropriately adjusted.

With the ink jet printer configured as described above, it is possible to achieve effects as follows.

<Effect 1>

The overflow starting point is formed on the liquid retention wall of the liquid retention portion of the cap. Accordingly, it is possible to discharge the moisture retention liquid retained in the liquid retention portion through the overflow starting point. It is possible to suppress the height of swelling of the moisture retention liquid and to avoid contact between the nozzle surface of the liquid jetting head and the moisture retention liquid.

In other words, the moisture retention liquid retained in the liquid retention portion is discharged through the overflow starting point. Therefore, it is possible to suppress the height of swelling of the moisture retention liquid with respect to the upper surface of the liquid retention wall of the liquid retention portion and to maintain the liquid surface of the moisture retention liquid protruding beyond the upper surface of the liquid retention wall of the liquid retention portion at approximately the position of the upper surface of the liquid retention wall of the liquid retention portion. It is possible to avoid contact between the nozzle surface of the liquid jetting head and the moisture retention liquid and to maintain a certain clearance between the nozzle surface of the liquid jetting head and the liquid surface of the moisture retention liquid.

<Effect 2>

The plurality of overflow starting points are formed on the liquid retention wall of the liquid retention portion along the longitudinal direction. Accordingly, even in a case where the levelness error of the cap comprising the liquid retention portion is great, it is possible to discharge the moisture retention liquid inside the liquid retention portion by using any of the plurality of overflow starting points.

<Effect 3>

The overflow starting points are formed in the opposite end portions in the longitudinal direction of the liquid retention portion. Even in a case where the levelness error of the cap comprising the liquid retention portion is great, it is possible to discharge the moisture retention liquid inside the liquid retention portion by using the overflow starting point on any of the ends in the longitudinal direction of the liquid retention portion.

<Effect 4>

The overflow starting point is formed on the liquid retention wall on a lower side of a slope in a case where the cap is disposed to be inclined in accordance with the liquid jetting head disposed to be inclined. In comparison with a case where the overflow starting point is formed on the liquid retention wall on an upper side of the slope, the moisture retention liquid is easily discharged.

[Description about Liquid Retention Portion According to Second Embodiment]

Figure 19:
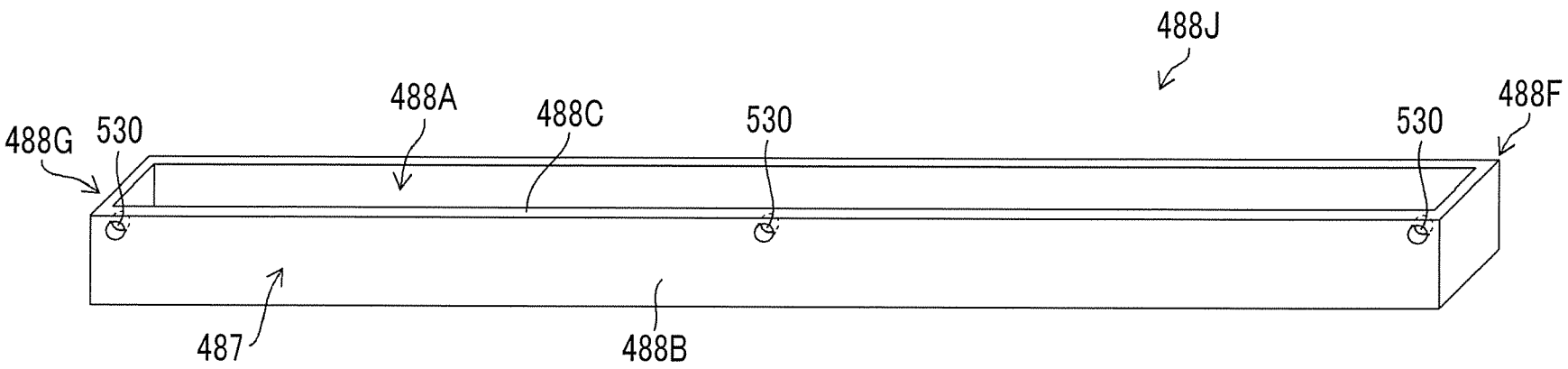
FIG. 19 is a perspective view illustrating an example of the structure of a liquid retention portion according to a second embodiment.

FIG. 19 is a perspective view illustrating an example of the structure of a liquid retention portion according to a second embodiment. In the case of a liquid retention portion 488J shown in FIG. 19, through-holes penetrating the liquid retention wall 488B in a thickness direction are formed in the liquid retention wall 488B as overflow starting points 530. FIG. 19 shows the through-holes of which the planar shape on the side surface 487 of the liquid retention wall 488B is circular. However, through-holes of which the planar shape is an elliptical shape, an oval shape obtained by combining a circular shape and a quadrangular shape, or the like may also be used as the overflow starting points 530.

The overflow starting points 530 are formed in an upper portion of the liquid retention wall 488B. Examples of the upper portion of the liquid retention wall 488B include an area of 2.0 millimeters around the upper surface 488C of the liquid retention wall 488B. The upper portion of the liquid retention wall 488B is determined in accordance with a position at which the liquid surface 500A of the moisture retention liquid 500 in the liquid retention portion 488 is to be maintained. The liquid surface 500A of the moisture retention liquid 500 is determined in the viewpoint of performing moisture retention of the nozzle surface and avoiding contact between the nozzle surface and the moisture retention liquid.

Conditions such as the size of the overflow starting points 530 and disposition thereof are determined in the same manner as the overflow starting points 510 shown in FIG. 11. The description thereof will be omitted here.

Modification Example

Figure 20:
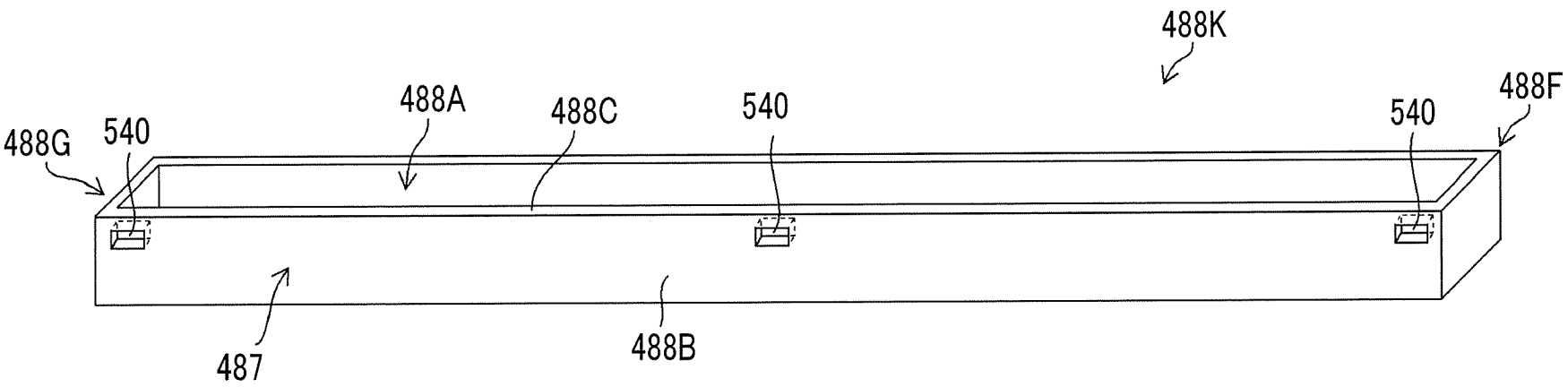
FIG. 20 is a perspective view illustrating an example of the structure of a liquid retention portion according to a modification example of the second embodiment.

FIG. 20 is a perspective view illustrating an example of the structure of a liquid retention portion according to a modification example of the second embodiment. In the case of a liquid retention portion 488K shown in FIG. 20, through-holes of which the planar shape on the side surface 487 of the liquid retention wall 488B is quadrangular are formed as the overflow starting points 540.

FIG. 20 shows the through-holes of which the planar shape on the side surface 487 of the liquid retention wall 488B is quadrangular. However, through-holes of which the planar shape is square may be used as the overflow starting points 540. In addition, instead of the through-holes of which the planar shape is quadrangular, polygonal through-holes of which the planar shape is pentagonal may be used as the overflow starting points 540.

[Effect of Liquid Retention Portion According to Second Embodiment]

With an ink jet printer comprising the liquid retention portion according to the second embodiment, it is possible to achieve the same effect as that of the ink jet printer comprising the liquid retention portion according to the first embodiment.

The overflow starting points in the second embodiment, which are the through-holes, and the overflow starting points in the first embodiment, which are the through-grooves, may be used together.

[Description about Liquid Retention Portion According to Third Embodiment]

Figure 21:
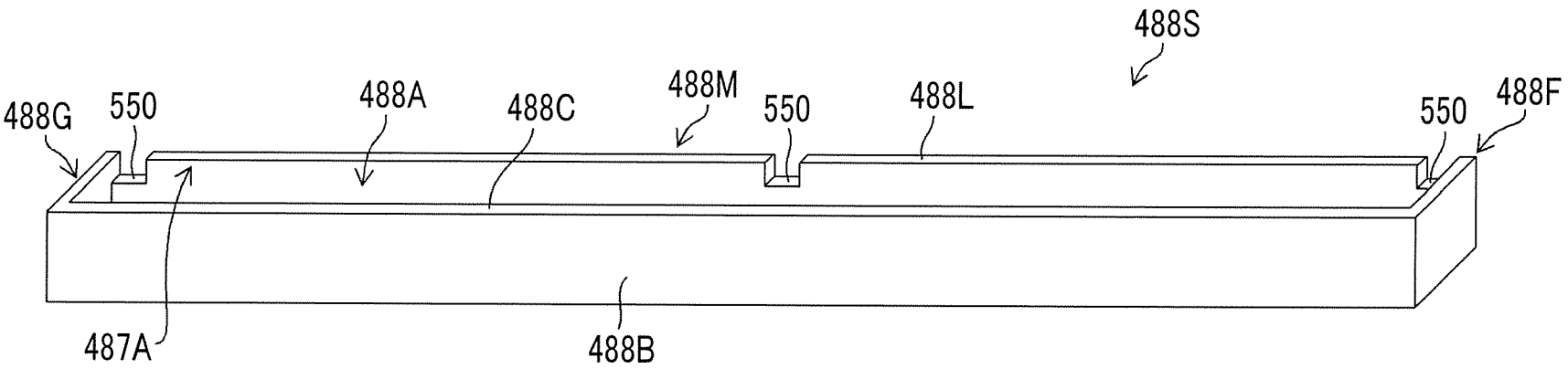
FIG. 21 is a perspective view illustrating an example of the structure of a liquid retention portion according to a third embodiment.

FIG. 21 is a perspective view illustrating an example of the structure of a liquid retention portion according to a third embodiment. In the case of a liquid retention portion 488S shown in FIG. 21, through-grooves as overflow starting points 550 are formed on an upper surface 488M of a liquid retention wall 488L on an upper side of a slope. The liquid retention wall 488L on the upper side of the slope is an example of a second wall.

FIG. 21 shows the through-grooves of which the planar shape on a side surface 487A of the liquid retention wall 488L is quadrangular. However, through-grooves of which the planar shape is triangular, semi-circular, or the like may be used as the overflow starting points 550. In addition, through-holes as overflow starting points may be provided instead of the through-grooves as the overflow starting points 550 or together with the through-grooves as the overflow starting points 550. As the planar shape of the through-holes, a circular shape, a polygonal shape, and the like can be applied.

Conditions such as the size of the overflow starting points 550 and disposition thereof are determined in the same manner as the overflow starting points 510 shown in FIG. 11. The description thereof will be omitted here.

In a case where the liquid retention portion 488S is disposed to be inclined in accordance with the cap disposed to be inclined, the liquid retention wall 488L may be on the upper side of the slope. A length from the upper surface of the liquid retention wall 488L to the overflow starting point 550 along the liquid retention wall 488L exceeds a length from the upper surface 488C of the liquid retention wall 488B shown in FIG. 11 to the overflow starting point 550 along the liquid retention wall 488B.

In other words, a length from the horizontal plane to the overflow starting point 550 formed on the liquid retention wall 488L shown in FIG. 21 is equal to a length from the horizontal plane to the overflow starting point 510 formed on the liquid retention wall 488B shown in FIG. 11.

[Effect of Liquid Retention Portion According to Third Embodiment]

With an ink jet printer comprising the liquid retention portion according to the third embodiment, it is possible to achieve the same effect as that of the ink jet printer comprising the liquid retention portion according to the first embodiment. In addition, it is possible to discharge moisture retention liquid in the liquid retention portion 488S by using the overflow starting points 550 formed on the liquid retention wall 488L on the upper side of the slope.

In a case where the moisture retention liquid in the liquid retention portion 488S is caused to overflow through the overflow starting points 550 formed on the liquid retention wall 488L on the upper side of the slope, the moisture retention liquid discharge ports 493 shown in FIG. 9 are formed on the upper side of the slope of the liquid retention portion 488. However, in the viewpoint of discharging moisture retention liquid, the moisture retention liquid discharge ports are preferably formed on a lower side of the slope as shown in FIG. 9.

The overflow starting points in the third embodiment can be used together with the overflow starting points in the first embodiment and the overflow starting points in the second embodiment. That is, the overflow starting points may be formed on at least one of a liquid retention wall on an upper side of a slope or a liquid retention wall on a lower side of the slope.

[Description about Liquid Retention Portion According to Fourth Embodiment]

Figure 22:
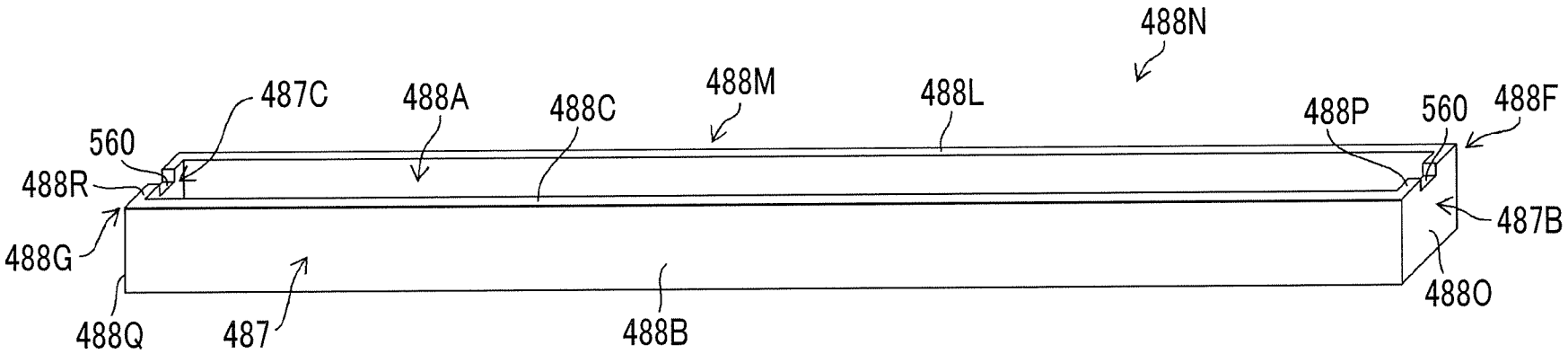
FIG. 22 is a perspective view illustrating an example of the structure of a liquid retention portion according to a fourth embodiment.

FIG. 22 is a perspective view illustrating an example of the structure of a liquid retention portion according to a fourth embodiment. In the case of a liquid retention portion 488N shown in FIG. 22, overflow starting points 560 are formed on an upper surface 488P of a liquid retention wall 488O of the one end portion 488F in the longitudinal direction of the liquid retention portion 488N and an upper surface 488R of a liquid retention wall 488Q of the other end portion 488G in the longitudinal direction of the liquid retention portion 488N. The liquid retention wall 488O is an example of a third wall. The liquid retention wall 488Q is an example of a fourth wall.

The overflow starting point 560 formed on the upper surface 488P of the liquid retention wall 488O is a through-groove penetrating the liquid retention wall 488O. In addition, the overflow starting point 560 formed on the upper surface 488R of the liquid retention wall 488Q is a through-groove penetrating the liquid retention wall 488Q.

Although not shown, a plurality of the overflow starting points 560 may be formed on the upper surface 488P of the liquid retention wall 488O. The same applies to the upper surface 488R of the liquid retention wall 488Q.

FIG. 22 shows the liquid retention portion 488N of which the overflow starting points 560 are formed on both of the liquid retention wall 488O and the liquid retention wall 488Q. However, an embodiment in which the overflow starting point 560 of the liquid retention wall 488O or the overflow starting point 560 of the liquid retention portion 488N is not provided can also be adopted.

FIG. 22 shows the through-grooves of which the planar shape on a side surface 487B of the liquid retention wall 488O and the planar shape on a side surface 487 C of the liquid retention wall 488Q are quadrangular. However, through-grooves of which the planar shape is triangular, semi-circular, or the like may be used as the overflow starting points 560. In addition, through-holes as overflow starting points may be provided instead of the through-grooves as the overflow starting points 560 or together with the through-grooves as the overflow starting points 560. As the planar shape of the through-holes, a circular shape, a polygonal shape, and the like can be applied.

Conditions such as the size of the overflow starting points 560 and disposition thereof are determined in the same manner as the overflow starting points 510 shown in FIG. 11. The description thereof will be omitted here.

[Effect of Liquid Retention Portion According to Fourth Embodiment]

With an ink jet printer comprising the liquid retention portion according to the fourth embodiment, it is possible to achieve the same effect as that of the ink jet printer comprising the liquid retention portion according to the first embodiment. In addition, it is possible to discharge moisture retention liquid in the liquid retention portion 488N by using at least one of the liquid retention wall 488O or the liquid retention wall 488Q, the liquid retention wall 488O and the liquid retention wall 488Q being at the ends in the longitudinal direction.

The overflow starting points in the fourth embodiment can be used together with the overflow starting points in at least one of the first to third embodiments.

Fifth Embodiment

In the case of a liquid retention portion according to a fifth embodiment, an overflow starting point is subject to a hydrophilic treatment. Examples of the hydrophilic treatment include forming a hydrophilic film, a surface modification treatment, or the like. Examples of hydrophilicity include an example where the angle of contact of the moisture retention liquid with respect to the overflow starting point is equal to or smaller than 90 degrees. The angle of contact of the moisture retention liquid with respect to an overflow starting point is preferably equal to or smaller than 45 degrees. The angle of contact of the moisture retention liquid with respect to an overflow starting point is more preferably equal to or smaller than 30 degrees.

[Effect of Liquid Retention Portion According to Fifth Embodiment]

In the case of the liquid retention portion according to the fifth embodiment, the wettability of the overflow starting point is improved. Accordingly, discharging properties of the moisture retention liquid at the overflow starting point can be improved.

[Description about Ink Jet Printer Control System]

The ink jet printer 101 described above comprises a system control unit that collectively controls each part of the apparatus. In addition, a control unit that individually controls each part of the apparatus is provided. The hardware structures of the system controller and the controller for each part of the apparatus are various processors as follow.

Note that, a processing unit may be expressed by "processing unit" in English. A processor may be expressed by "processor" in English.

The various processors include a CPU which is a general-purpose processor executing a program and functioning as various processing units, a PLD such as an FPGA which is a processor of which the circuit configuration can be changed after being manufactured, a dedicated electric circuit such as an ASIC which is a processor having a circuit configuration designed for performing a specific process, and the like. The program has the same meaning as software.

Note that, the "FPGA" is an abbreviation of "field programmable gate array". The "PLD" is an abbreviation of "programmable logic device". The "ASIC" is an abbreviation of "application specific integrated circuit".

One of the various processors may constitute one processing unit and two or more same type of processors or two or more different type of processors may constitute one processing unit. For example, a plurality of FPGAs or a combination of a CPU and an FPGA may constitute one processing unit. In addition, one processor may constitute a plurality of processing units. As examples of a case where one processor constitutes a plurality of processing units include, first, there is a case where a combination of one or more CPUs and software constitutes one processor such that the processor functions as a plurality of processing units as in the case of a computer such as a client or server. Second, there is a case where a processor that realizes the functions of the entire system including a plurality of processing units by means of one IC chip is used as in the case of an SoC. As described above, various processing units are configured by using one or more of the various processors, as hardware structures.

Furthermore, the hardware structures of the various processors are electric circuits obtained by combining circuit elements such as semiconductor elements with each other, more specifically.

Note that, the "SoC" is an abbreviation of "system on chip", which means a system on chip in English. The "IC" is an abbreviation of "integrated circuit", which means an integrated circuit in English. The electric circuit may be expressed by "circuitry" in English.

[Application Example of Maintenance Device]

The maintenance device 400 of the ink jet printer 101 can be configured as a liquid jetting head maintenance device independent of an ink jet printer. That is, the present specification discloses a maintenance device comprising a head moving mechanism and a cap. Note that, the head moving mechanism may be a constituent element of an ink jet printer.

[Application Example of Moisture Retention Device]

The cap 480 provided in the maintenance device 400 of the ink jet printer 101 can be configured as a liquid jetting head moisture retention device independent of an ink jet printer and a maintenance device. That is, the present specification discloses a liquid jetting head moisture retention device comprising a liquid retention portion in which moisture retention liquid is stored.

[About Medium]

The paper is an example of a medium used for forming an image. The term "paper" can be understood as a generic term for papers called with various terms such as "recording paper", "printing paper", "printing medium", "printing medium", "printing target medium", "image forming medium", "image forming target medium", "image receiving medium", and "jetting target medium". The material, shape, or the like of the medium is not particularly limited and various sheets such as a sealing paper, a resin sheet, a film, a fabric sheet, a non-woven fabric sheet, or the like can be used regardless of the material and the shape thereof.

The paper is not limited to a sheet-type medium and may be a continuous medium such as a continuous paper. In the case of the ink jet printer in the present embodiment, a configuration in which a continuous medium is fed after being cut to a specific size or a configuration in which a continuous medium is discharged after being cut to a specific size after image formation may be adopted as long as the continuous medium is separated into medium sheets at a stage of being stacked on the accumulation unit.

[About Terms]

The term "printer" includes the concept of terms such as "printing apparatus", "printer", "printing apparatus", "image recording apparatus", "image forming apparatus", "image outputting apparatus", and "image drawing apparatus". In addition, the term "printing apparatus" includes the concept of a printing system obtained by combining a plurality of apparatuses.

The "image" is to be interpreted in a broad sense and includes a color image, a monochrome image, a single-color image, a gradation image, a uniform density image, and the like. The uniform density image may be called "solid image". The "image" is not limited to a photographic image and is used as a generic term for a drawing pattern, a text, a symbol, a line drawing, a mosaic pattern, a color-coded pattern, and other various patterns or an appropriate combination thereof.

The term "printing" includes the concept of terms such as image formation, image recording, printing, drawing, and printing. In addition, the term "printing" may be used as a term for a concept including an aftertreatment such as a varnishing process performed after image formation.

The term "orthogonal" or "perpendicular" in the specification includes a state where the substantially same effect as in a case where the angle of intersection is 90° is achieved out of states where the angle of intersection is smaller than 90° or greater than 90°.

The term "parallel" in the specification includes a state of being able to be considered as a state of being substantially parallel such that the approximately same effect as in a case of being parallel is achieved out of states of being not parallel in the strict sense.

The term "same" in the specification includes a state of being able to be considered as a state of being substantially the same such that the approximately same effect as in a case of being the same is achieved out of states of being different in the strict sense.

The term "upper" represents a direction opposite to the gravity direction and a side opposite to the gravity direction. The term "lower" means the gravity direction and the same side as the gravity direction.

[About Combination of Embodiments, Modification Examples, and Like]

The configurations described in the above-described embodiment and the points described in the modification examples can be used by being appropriately combined with each other and a part of the points can be substituted.

With regard to the embodiments of the invention described above, modification, addition, and deletion of constituent elements can be appropriately made without departing from the spirit of the invention. The invention is not limited to the above-described embodiments and various modifications can be made within the technical idea of the invention by those who have ordinary knowledge in the art.

EXPLANATION OF REFERENCES

20: nozzle
22: ejector
24: individual supply path
26: supply side common tributary flow path
50: pressure chamber
52: piezoelectric element
54: nozzle flow path
56: vibration plate
58: individual electrode
60: piezoelectric substance
66: cover plate
68: movable space
101: ink jet printer
110: paper feeding unit
112: paper feeding device
112A: paper feeding tray
114: feeder board
116: paper feeding drum
120: treatment liquid applying unit
122: treatment liquid applying drum
123, 133, 143: gripper
124: treatment liquid applying device
130: treatment liquid drying unit
132: treatment liquid drying drum
134: warm air blower
140: drawing unit
142: drawing drum
144: head unit
146, 146C, 146M, 146Y, 146K: liquid jetting head
146A, 146A-i: nozzle surface
147-*i*: head module
148: scanner
150: ink drying unit
160: accumulation unit
162: accumulation device
162A: accumulation tray
210: chain delivery
212: chain
214: gripper
220: paper guide
222: first paper guide
224: second paper guide
228, 486A: elastic member
230: warm air blowing unit
250: paper detection sensor
309: cable
310: supporting frame
311: dummy plate
311A: surface
312, 312-*i*: nozzle disposition portion
350: nozzle array

351: nozzle opening
400: maintenance device
402: head moving mechanism
410: head supporting frame
412: frame transporting device
414: head supporting portion
416: guide rail
417: slider
418: sending device
418A: sending screw
418B: nut member
418C: motor
460C, 460M, 460Y, 460K: wiping unit
462: wiping web
464: pressing roller
466: waste liquid tray
467: waste liquid recovery pipe
468: waste liquid tank
480, 480C, 480M, 480Y, 480K: cap
481: closed space
482: cap main body
484, 488A: opening portion
486: sealing member
486A: elastic member
487, 487A, 487B, 487C: side surface
488, 488D, 488E, 488H, 488I, 488J, 488K, 488N, 488S: liquid retention portion
488B, 488L, 488O, 488Q: liquid retention wall
488C, 488M, 488P, 488R: upper surface
488F, 488G: end portion
489: bottom surface
490: upper stage portion
491: lower stage portion
492: moisture retention liquid supply port
493: moisture retention liquid discharge port
494: bolt
500: moisture retention liquid
500A: liquid surface
510, 510A, 510B, 510C, 510E, 520, 530, 540, 550, 560: overflow starting point
510D: bottom portion

What is claimed is:

1. A moisture retention device comprising:
a cap for moisture retention of a nozzle surface of a liquid jetting head,
wherein the cap comprises a liquid retention portion in which moisture retention liquid is retained,
wherein the liquid retention portion is a housing of which an upper surface is open and a wall of the housing is provided with an overflow starting point having a structure that penetrates the wall,
wherein the liquid retention portion has a shape of which a length in a first direction is longer than a length in a second direction orthogonal to the first direction, and
wherein the overflow starting point is formed on at least one of a first wall along the first direction or a second wall along the first direction.

2. The moisture retention device according to claim 1,
wherein the overflow starting point includes a through-groove formed on an upper surface of the wall.

3. The moisture retention device according to claim 1,
wherein the overflow starting point includes a through-hole formed in the wall.

4. The moisture retention device according to claim 1,
wherein the overflow starting point is subjected to a hydrophilic treatment.

5. The moisture retention device according to claim 1,
wherein a plurality of the overflow starting points are formed on at least one of the first wall or the second wall.

6. The moisture retention device according to claim 1,
wherein the cap is disposed to be inclined with respect to a horizontal plane in accordance with the liquid jetting head that is disposed to be inclined with the nozzle surface disposed to be inclined with respect to the horizontal plane, and
wherein the overflow starting point is formed on the wall on a lower side of a slope of the liquid retention portion that is disposed to be inclined with respect to the horizontal plane in accordance with the cap.

7. The moisture retention device according to claim 1,
wherein the cap comprises a moisture retention liquid discharge port through which the moisture retention liquid overflowing out of the liquid retention portion is discharged to an outside of the cap.

8. A maintenance device comprising:
a moisture retention device for moisture retention of a nozzle surface of a liquid jetting head,
wherein the moisture retention device comprises a cap comprising a liquid retention portion in which moisture retention liquid is retained,
wherein the liquid retention portion is a housing of which an upper surface is open and a wall of the housing is provided with an overflow starting point having a structure that penetrates the wall,
wherein the liquid retention portion has a shape of which a length in a first direction is longer than a length in a second direction orthogonal to the first direction, and
wherein the overflow starting point is formed on at least one of a first wall along the first direction or a second wall along the first direction.

9. A liquid jetting apparatus comprising:
a liquid jetting head; and
a moisture retention device for moisture retention of a nozzle surface of the liquid jetting head,
wherein the moisture retention device comprises a cap comprising a liquid retention portion in which moisture retention liquid is retained,
wherein the liquid retention portion is a housing of which an upper surface is open and a wall of the housing is provided with an overflow starting point having a structure that penetrates the wall,
wherein the liquid retention portion has a shape of which a length in a first direction is longer than a length in a second direction orthogonal to the first direction, and
wherein the overflow starting point is formed on at least one of a first wall along the first direction or a second wall along the first direction.

* * * * *